United States Patent [19]

Iwaska et al.

[11] 3,967,702

[45] July 6, 1976

[54] CONTROL APPARATUS FOR ELEVATORS

[75] Inventors: Tatsuo Iwaska; Takeo Yuminaka; Takashi Kaneko; Hiroshi Kinoshita, all of Katsuta, Japan

[73] Assignee: Hitachi, Ltd., Japan

[22] Filed: Dec. 16, 1974

[21] Appl. No.: 533,026

[30] Foreign Application Priority Data

Dec. 19, 1973 Japan ..... 48-141213
Feb. 20, 1974 Japan ..... 49-19432

[52] U.S. Cl. ..... 187/29 R; 340/19 R
[51] Int. Cl.[2] ..... B66B 3/00
[58] Field of Search ..... 187/29; 340/19, 20

[56] References Cited

UNITED STATES PATENTS

| | | | |
|---|---|---|---|
| 2,193,609 | 3/1940 | Williams et al. | 340/19 |
| 3,065,823 | 11/1962 | Burgy | 187/29 |
| 3,176,797 | 4/1965 | Dinning | 187/29 |

*Primary Examiner*—Gene Z. Rubinson
*Assistant Examiner*—W. E. Duncanson, Jr.
*Attorney, Agent, or Firm*—Craig & Antonelli

[57] ABSTRACT

Elevator cars for servicing a plurality of floors are under the control of register means provided at elevator halls to registrate the hall calls for the up- and down-directions. Detector means are installed at the elevator halls to detect the number of the passengers awaiting the cars at the halls. Discriminator means are employed to obtain the information concerning the number of the car awaiting passengers classified for each of the directions of their destinations. The information thus obtained is utilized in the elevator control apparatus to operate the elevator system with a high working efficiency. When the hall calls for one direction are registrated, the detected number of the car awaiting passengers is regarded as the number of the awaiting passengers for the hall calls of the above one direction. When the hall calls for the two directions are registrated, the detected number of the car awaiting passengers are divided into two classes, one for one direction and the other class for other direction on the basis of an appropriate dividing ratio, to thereby detect the number of the awaiting passengers for each of the directions of their destinations. This information about the number of the passengers for each of the directions is utilized in the elevator control operation for allotting the registrated hall calls to the cars. Adder devices are provided for adding together the number of the car awaiting passengers relevant to the allotted hall calls and the number of the passengers in the car to estimate the number of the passengers to be transported by the car. The information of the estimated number of the passenger is utilized for predicting the possible occurrence of the car-full condition. The allotment of the hall calls to the car for which the no-vacancy condition is predicted is restricted.

20 Claims, 30 Drawing Figures

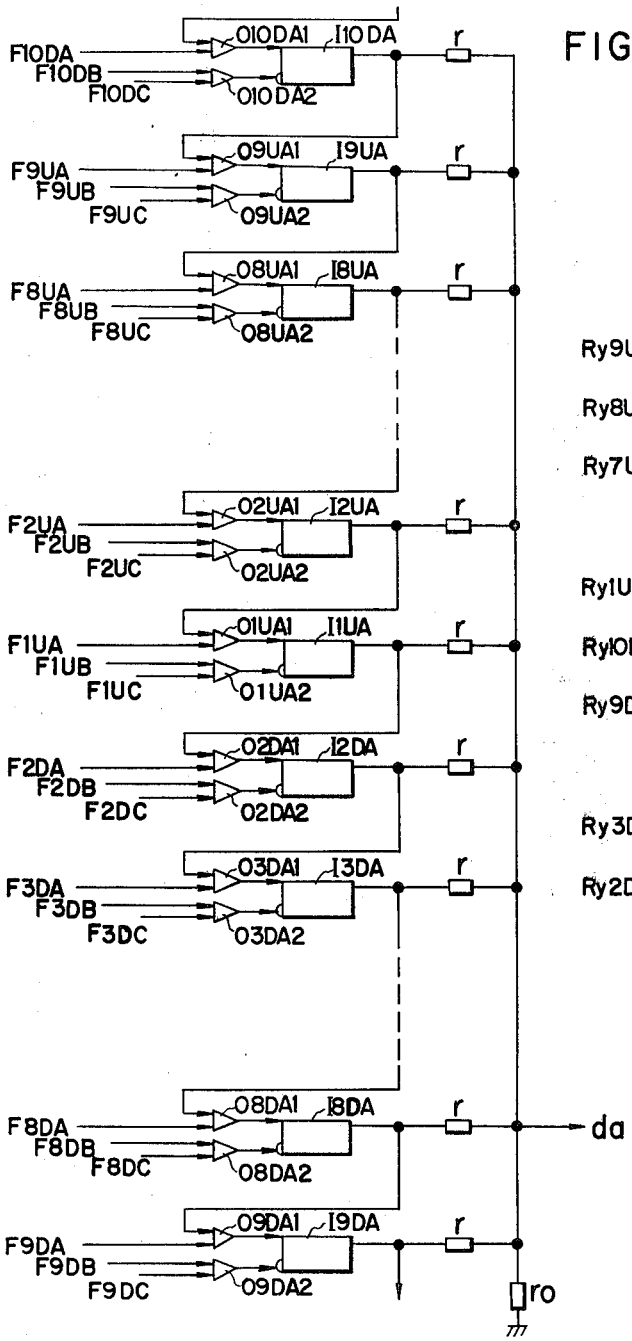
FIG. 12
FIG. 13
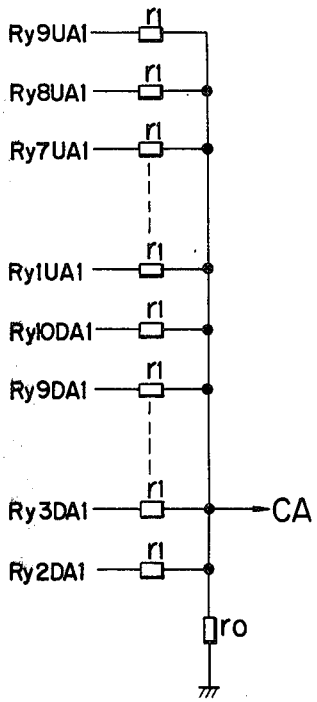

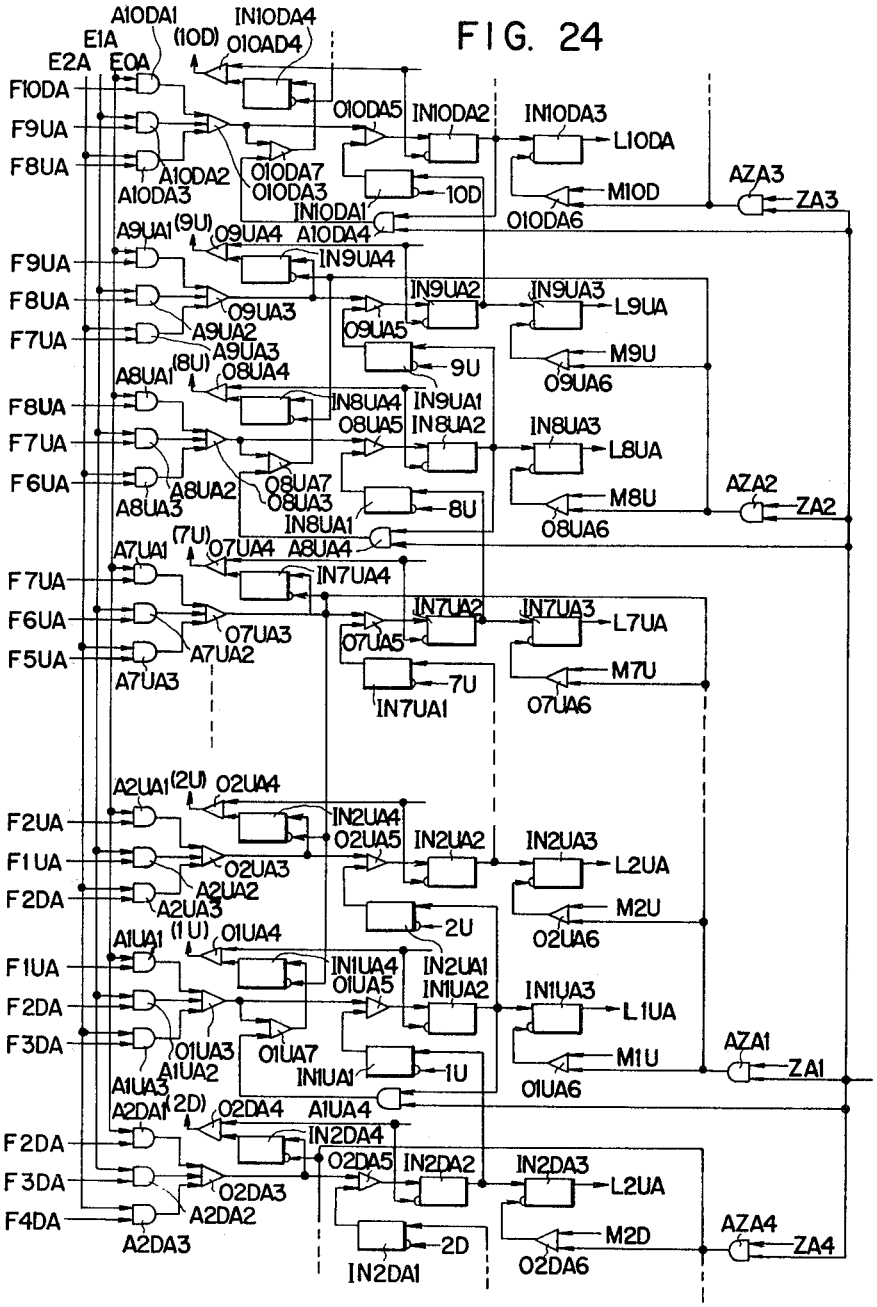
FIG. 24
A10DA1
IN10DA4
E1A
(10D)
O10AD4
E2A
E0A
F10DA
F9UA
F8UA
O10DA5
IN10DA2
IN10DA3
L10DA
A10DA2
O10DA7
O10DA3
10D
M10D
AZA3
ZA3
A10DA3
IN10DA1
O10DA6
A9UA1
(9U)
O9UA4
A10DA4
F9UA
IN9UA4
F8UA
IN9UA2
IN9UA3
L9UA
O9UA3
A9UA2
O9UA5
F7UA
A9UA3
9U
M9U
A8UA1
(8U)
O8UA4
O9UA6
F8UA
IN8UA4
IN9UA1
O8UA5
IN8UA2
IN8UA3
F7UA
L8UA
F6UA
A8UA2
O8UA7
O8UA3
M8U
AZA2
ZA2
A8UA3
8U
IN8UA1
O8UA6
A7UA1
(7U)
O7UA4
A8UA4
F7UA
IN7UA4
F6UA
IN7UA2
IN7UA3
L7UA
O7UA3
O7UA5
F5UA
A7UA2
M7U
A7UA3
7U
IN7UA1
O7UA6
A2UA1
(2U)
O2UA4
F2UA
IN2UA4
O2UA5
IN2UA2
IN2UA3
F1UA
O2UA3
L2UA
A2UA2
F2DA
A2UA3
M2U
2U
O2UA6
A1UA1
(1U)
O1UA4
F1UA
IN1UA4
IN2UA1
O1UA5
IN1UA2
IN1UA3
F2DA
L1UA
F3DA
O1UA3
O1UA7
M1U
AZA1
ZA1
A1UA2
IN1UA1
1U
O1UA6
A1UA3
A2DA1
(2D)
O2DA4
A1UA4
F2DA
IN2DA4
O2DA5
IN2DA2
IN2DA3
F3DA
O2DA3
L2UA
F4DA
A2DA2
M2D
AZA4
ZA4
A2DA3
2D
IN2DA1
O2DA6

CONTROL APPARATUS FOR ELEVATORS

The present invention relates to a control apparatus for elevators.

Lately, as the tendency for constructing higher buildings of multi-floor structure has been increased, many attempts have been made to speed up the movement of the elevator car and install an increased number of cars in juxtaposition. Besides, demand for the control apparatus which allows the operation of the elevator system with a high efficiency to enhance the services provided by the elevator is also increased.

In general, various traffic information concerning the operation of the elevator system is required in order to control the elevator with a high efficiency. As more traffic information is available, a more accurate and appropriate control can be assured. For example, when the information concerning the spatial distance between the elevator cars, the number of the calls for which the cars are to be stopped or the like traffic information is utilized as the control factors, an effective interval control can be attained to enhance the working efficiency of the elevator system.

On the other hand, in the elevator system in which a plurality of cars are arranged in juxtaposition or in groups, attempts have been made to rapidly select the car which can readily respond to the produced hall call on the basis of the available various traffic information. In other words, it is desirable to rapidly allot the generated hall calls to the car which is best suited to service the call, whereby the cars are efficiently operated for the respective hall calls. It is also known that the information of the car to which a hall call is allotted is previously advised to the car awaiting passengers at the hall from which the call is dispatched. The passengers then can await the car without any anxiety, whereby the left-off or the dashing into the car is evaded.

Many systems have been proposed for allotting the hall calls to the relevant cars. For example, U.S. Pat. No. 3,729,066 teaches a method according to which the hall calls produced at the floors in the region defined by two successive cars are allotted to the succeeding car. According to another known system, all the floors receiving the service of the elevator cars are grouped into a plurality of zones and the hall calls produced in a zone are allotted to the car located at the zone.

These known methods, however, can not be evaded from certain difficulties. For example, there may arise such a trouble that a car which is allotted with so many hall calls that the left-off of the passengers or no-vacancy condition may be produced after the service for all the calls is nevertheless allotted with new calls when produced. The elevator car in such condition can not service the new calls even if the car is stopped at the floors from which the new hall calls are generated. The passenger can not get into such filled car and must again push the call button to thereby register another hall call and wait for the service by the other car. Such phenomenon is of course undesirable, since the passengers have to await the car for a long time. In order to eliminate the above disadvantage, it is conceived that, when the car becomes in the full condition, the hall calls allotted to the car which can no more service the calls may be re-allotted to other cars. However, this solution is accompanied with another problem that, when the elevator system is provided with display means to inform the passengers of the car which responded to the call from the passenger, the display has to be altered symultaneously with the alteration of the allotment, which results in the lowered reliability of the display means.

The above unwanted phenomena or problems are ascribable to the fact that the car can not previously estimate the number of the passengers which is subjected to variation in the course of transporting operation. The information which the car can detect is only the number of the passengers within the car in the conventional elevator system.

An object of the present invention is to provide a means for detecting as the hitherto unknown traffic information the numbers of the passengers awaiting the car at hall for every direction of the registered hall calls to thereby make it possible to control the operation of the elevator system with a high efficiency by utilizing the above new traffic information.

Another object of the present invention is to provide a means capable of estimating the number of the passengers which may be increased in the course of the service by the car for the allotted hall calls to thereby make it possible to control the operation of the elevator system by utilizing the above information of the estimated number of the passengers to be carried by the elevator car.

Further object of the invention is to provide a means for effectively allotting the hall calls to the cars by considering the number of the passengers in the car which is subjected to variation in the course of the running of the car, to thereby enhance the working efficiency of the car and the service to the passengers awaiting at halls.

According to one aspect of the invention, the number of the passengers awaiting the car is detected. When the hall calls for one direction are registered, the detected number of the car awaiting passengers is regarded as the number of the passengers for the hall call of the above one direction. When the hall calls for the two directions are registered, the detected number of the car awaiting passengers are divided into two classes, one for one direction and the other for the other direction on the basis of an appropriate dividing ratio, to thereby detect the number of the awaiting passengers for each of the directions of the registered calls.

According to another aspect of the invention, the number of the passengers in the car is added to the number of the car awaiting passengers for the direction of the hall calls allotted to the car to thereby make it possible to estimate the number of the passengers to be carried by the car.

According to another aspect of the invention, the car whose estimated number of the passengers exceed a predetermined value is prevented from being allotted with additional hall calls.

The above and other objects, novel features as well as the advantages of the invention will be made more apparent from the description of preferred embodiments of the invention. The description makes reference to the accompanying drawings.

FIGS. 1 to 5 show an arrangement of a circuit for detecting the number of the car awaiting passengers for every direction of the hall calls, wherein FIG. 1 shows schematically an arrangement of an elevator hall provided with photo-detector apparatus at the entrance thereof to detect the number of the passengers awaiting cars at the hall;

FIG. 2 shows a circuit for determining the number of the car awaiting passengers from the output of the photo-detector apparatus shown in FIG. 1;

FIG. 3 is a circuit diagram showing a registration circuit;

FIG. 4 is a circuit for detecting separately the numbers of the awaiting passengers for every direction of the destinations according to the invention;

FIG. 5 shows another circuit for setting the dividing ratio for dividing the number of the passengers awaiting at the hall in the circuit shown in FIG. 4;

FIGS. 6 to 8 show another embodiment of the circuit for detecting the number of the car awaiting passengers for each of the directions of destinations, wherein FIG. 6 shows a circuit for detecting the numbers of the passengers getting into the car separately for each of the directions;

FIG. 7 shows a circuit for calculating the ratio for dividing the number of the awaiting passengers in respect of the directions of their destinations;

FIG. 8 shows a circuit for detecting the number of the car awaiting passengers for each of the directions of their destinations;

FIGS. 12 to 24 show a circuit arrangement for the control apparatus shown in FIG. 10, in which:

FIG. 12 shows a circuit provided for every car to detect the spatial distance between the car A and the succeeding car;

FIG. 13 shows a circuit provided for every car to detect the number of the calls in response to which the car A is to be stopped;

FIG. 14 shows a circuit for detecting an average number of the calls for which all the cars are to be stopped;

FIG. 15 shows a circuit for producing a reference voltage for the comparator shown in FIG. 16;

FIG. 16 shows a comparator circuit provided for every car to determine the time interval of the car;

FIG. 17 shows a circuit provided for every car to set the service zone for the car according to the principle of the invention;

FIG. 18 shows an inhibit signal generation circuit to prevent the hall calls allotted for a car from being additionally allotted to another car;

FIG. 19 shows a priority setting circuit provided for every floor to determine the priority of the cars to be allotted with the hall calls;

FIG. 20 shows a circuit for allotting the hall calls to the car A, similar circuit being provided for every car;

FIG. 21 shows a pilot lamp display circuit to inform to the passengers at hall that the car A will service the hall call dispatched by them;

FIG. 22 shows an adder circuit for adding the numbers of the car awaiting passengers for the direction of the allotted hall calls according to the principle of the invention;

FIG. 23 shows an estimated passenger number determining circuit for estimating the number of the passengers to be carried by the car A and predicting the possibility of the car-full condition for the car A, similar circuit being provided for every cars;

FIGS. 24 to 28 show another embodiment of the elevator control apparatus according to the invention, in which:

FIG. 24 shows a circuit for setting the service zone for the car A according to the principle of the invention, similar circuit being provided for every car;

FIG. 25 shows a circuit for detecting the floor region in which the car A is located according to the invention, similar circuit being provided for every car;

FIG. 26 shows a circuit for detecting the hall calls allotted to the car A for every floor region according to the invention, similar circuit being provided for every car;

FIG. 27 shows a circuit for adding the numbers of the car awaiting passengers for the direction of the allotted hall calls according to the invention;

FIG. 28 shows a circuit for determining the estimated number of the passengers to be carried by the car A according to the invention, similar circuit being provided for every car;

In the first place, with the aid of an exemplary embodiment of the invention shown in FIGS. 1 to 5, a system for detecting the number of passengers awaiting the elevator cars at a floor hall as classified in dependence upon the destinations.

In order to detect the number of passengers awaiting the cars at the hall in dependence on the directions of the destinations intended by the passengers, it is necessary first to determine the number of the awaiting passengers regardless of the destinations. Lately, various types of apparatus for detecting the number of the passengers awaiting the cars at the hall have been proposed and developed. For example, there is known such an apparatus in which a plurality of mat switches are distributed on the floor of the elevator hall, each arranged in a divided floor area required for a single passenger, to determine the number of the passengers at the hall on the basis of the number of switches actuated by the passengers. According to another known system, ultrasonic wave transmitters and receivers are provided on the ceiling or the side walls of the elevator hall, whereby the number of the awaiting passengers is determined as a function of the quantity of the ultrasonic waves transmitted by the transmitters and reflected by the passengers. Further, the detecting system employing an industrial television camera mounted in the hall at a suitable place or the optical detecting system employing light transmitters and photo-receivers arranged at the entrance and the exit of the elevator hall to detect the number of the passengers entered the hall or the like systems are attempted.

Figure 1:
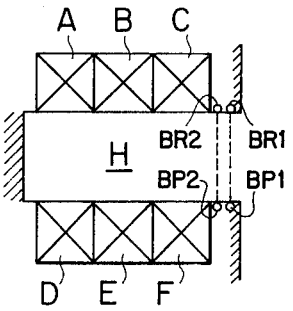
Figure 2:
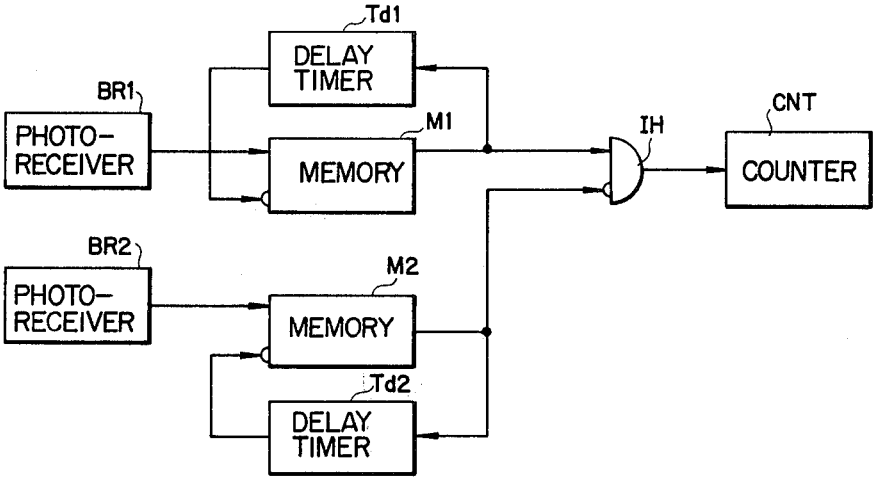

In FIGS. 1 and 2, a system for detecting the number of the awaiting passenger at an elevator hall is illustrated in which the light transmitters and the photo-receivers are provided at the entrance and exit of the hall to thereby determine the number of the passengers based on the number of persons entering the hall.

FIG. 1 shows schematically an arrangement of an elevator hall, in which six elevator cars A to F are provided in two groups with the cars belonging to each group being juxtaposed to one another, while the elevator hall H in a form of a blind lane is interposed between the car groups. It will be appreciated that, in case of the elevator hall of such dead lane configuration, all the persons entered the hall may be regarded as the passengers who wish to use the elevator cars. Accordingly, the number of the passengers awaiting the car can be determined by counting the number of the persons entering or leaving the hall by means of a pair of the light transmitter-receiver systems provided at the entrance of the elevator hall as is shown in FIG. 1. The light transmitters are designated by $BP_1$ and $BP_2$, while the corresponding photo-receivers are denoted by $BR_1$ and $BR_2$ in the drawing. For the convenience of description, the state of the photo-receiver $BR_1$ or $BR_2$ in which the receiver does not receive the light from the transmitter $BP_1$ or $BP_2$ is referred to as the operating or actuated state. It will be noted from the arrangement shown in FIG. 1 that the actuation of the photo-receiver $BR_2$ after the operation of the other receiver $BR_1$ will mean the ingress of the passengers into the hall for use of the elevator. On the contrary, the operations of the photo-receivers in the reversed order will mean the egress of the passengers landed from the elevator cars A to F. Thus, by effecting the counting operation only when the actuation of the photo-receiver $BR_1$ is followed by that of $BR_2$, it is possible to detect the number of the passengers awaiting the cars at the hall H.

A circuit designed for the above mentioned detecting operation is schematically shown in FIG. 2 in a block diagram. A signal from the photo-receiver $BR_1$ is stored in a memory element $M_1$ which is adapted to be automatically reset by the output signal from a delay timer $Td_1$ after expiry of a predetermined time duration. In a similar manner, the signal from the photo-receiver $BR_2$ is stored in a memory $M_2$ which is also automatically reset by the output from a timer $Td_2$ after a predetermined time interval. The signals from the photo-receivers $BR_1$ and $BR_2$ are both applied to an inhibit element IH as inputs thereto. It is, however, to be noted that the signal from the photo-receiver $BR_2$ represents an inhibit signal. In this way, only the operations of the photo-receivers $BR_1$ and $BR_2$ in this order allow the generation of a signal from the output of the inhibit element IH. By counting the signal from the inhibit element IH by means of a conventional counter CNT, the number of the passengers awaiting at the hall H can be detected or determined. The counter CNT is so arranged that the content or counts thereof may be cleared when the hall call is reset after having been serviced.

Figure 3:
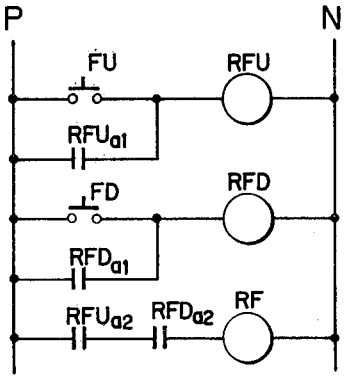

FIG. 3 shows an example of a circuit for the registration of the hall call. This circuit is provided for every floor. However, the description will be made herein to the hall call registration circuit for the Fth floor by way of an example.

When a hall call button FU for the up-direction provided at the Fth floor is pressed, a relay RFU is turned on by a closed circuit extending from a power supply line P through the push button switch FU and the relay RFU to a line N and holds itself through a self-hold circuit extending from P through an auxiliary relay $RFU_{a1}$ and the relay RFU to the line N. In a similar manner, the actuation of the hall call button switch FD for the down-direction brings about the energization of a relay RFD which is maintained in the energized state by an associated self-holding contact $RFD_{a1}$. When the hall calls for the both directions have thus been registered, contacts $RFU_{a2}$ and $RFD_{a2}$ are thereby closed, which results in the energization of a relay RF to indicate that the hall calls for the both directions are registered.

Figure 4:
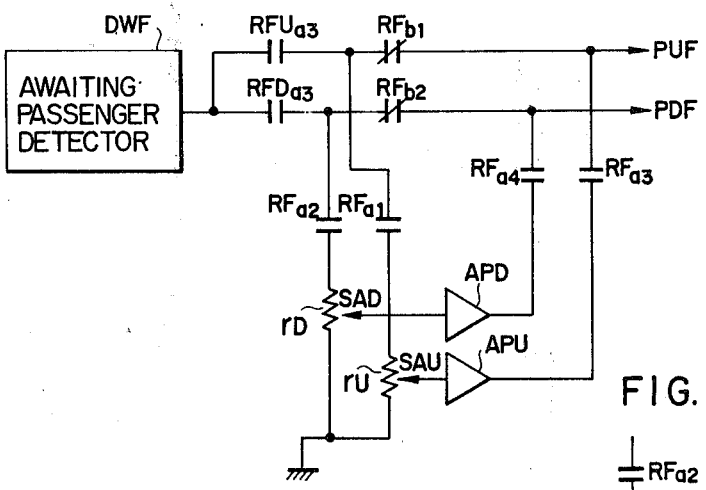

FIG. 4 shows an embodiment of the inventive circuit for determining the number of the awaiting passengers for each of the directions for which the hall calls are generated. Although such detection circuit is provided for every floor, description will be made to the one installed on the Fth floor. It should be appreciated that the operations of the detection circuits for all the floors are carried out in the same manner.

Referring to FIG. 4, the reference character DWF indicates a detector for determining the number of the awaiting passengers installed at the elevator hall of the Fth floor, which detector corresponds to the detecting apparatus for determining the number of awaiting passengers as described above with reference to FIGS. 1 and 2. Further, the contacts indicated by the same reference symbols as in FIG. 3 are the contacts of the relays RFU, RFD and RF shown in FIG. 3.

In case only the hall calls for the up-direction are generated, the relay RFU shown in FIG. 3 is energized, whereby the contact $RFU_{a3}$ is closed. Accordingly, the detection signal from the detector DWF for detecting the number of the awaiting passengers is output as it is through the closed circuit extending from DWF through $RFU_{a3}$ to $RF_{b1}$ as the signal PUF representing the number of the awaiting passengers. In a similar manner, when only the hall calls for the down-direction are generated, the detection signal of the detector DWF is output as the signal PDF representative of the number of the awaiting people.

On the other hand, when the both hall calls for the up- and down-directions are produced, the relay RF shown in FIG. 3 is turned on together with the energizations of the relays RFU and RFD. The contacts $RF_{b1}$ and $RF_{b2}$ are then turned off to open the above circuit, whereby the detection signal of the detector DWF is now applied to variable resistors $r$U and $r$D through the circuit of $RFU_{a3}$ and $RF_{a1}$ and the circuit of $RFD_{a3}$ and $RF_{a2}$, respectively. The variable resistors $r$U and $r$D may be composed of a potentiometer and are adapted to produce the corresponding detection signals derived from the detector DWF at the respective terminals SAU and SAD as divided at the ratios set at the resistors. These signals are then output through respective amplifiers APU and APD as well as the contacts $RF_{a3}$ and $RF_{a4}$ as the signals PUF and PDF representing, respectively, the numbers of the passengers awaiting the lifting and the lowering elevator cars. The amplifiers APU and APO serve to increase the input impedances and may be omitted when the impedanced coupled to the outputs PUF and PDF is sufficiently great as compared with the impedances of the resistors $r$U and $r$D.

As will be understood from the foregoing description, according to the invention, the hall calls for the both directions produced at the one and same floor are detected by the detector DWF, the detection signal of which are then divided by the variable resistors $r$D and $r$U to produce the signals which represent the numbers of the passengers waiting at the hall for the lifting and the lowering cars, respectively. It is noted that the number of the passengers divided for each of the directions of the elevator cars is dependent on the dividing ratios set at the variable resistors *r*U and *r*D. The dividing ratios may be arbitrarily selected by adjusting the set values of the variable resistors *r*U and *r*D. In this connection, it is of course desirable to select the above ratios on the basis of the destinations intended by the passengers awaiting at the floor in order to detect the appropriate numbers of the awaiting passengers for every direction. This can be accomplished by determining the ratio between the number of the passengers for one direction and the number of the passengers for the other direction on the basis of the corresponding antecedent records on the concerned floor and setting the thus obtained ratio at the variable resistors *r*U and *r*D. Further, since the above ratio may be different from one floor to another, the ratio should be appropriately selected in consideration of the traffic condition at the individual floors to be provided with the apparatus according to the invention.

Besides, the dividing ratio as described above may vary in dependence upon the traffic demand conditions or running conditions. For example, at the beginning of the office hours in the mmorning, most of passengers will wait for the cars in the up-direction (morning up-peak), while at the end of the office hours, most of the passengers will require the lowering cars (evening down-peak). Additionally, during the normal traffic period or at the lunch time, the traffic conditions will be different from the other hour bands. The adjustment of the dividing ratio independence upon these traffic conditions is therefore desirable for an appropriate and correct determination of the numbers of the passengers awaiting the cars for the different directions thereof. As a means for detecting the traffic demand conditions as above mentioned, there is known an apparatus disclosed in U.S. Pat. No. 3,642,099, for example. According to the teaching of this patent, the prevailing demand condition is detected starting from the hall calls or cage calls. As a more simple and convenient way for recognizing the traffic demand conditions, it is also conceivable to divide a daytime into a plurality of different hour bands for the operation of the elevator such as the morning service hour band at the beginning of the office hours, lunch hour band, evening service hour band at the end of the office hours and the normal traffic hour band or period. At any rate, it is preferred to adjust the values set at the variable resistors *r*U and *r*D in consideration of the available traffic demand conditions.

Figure 5:
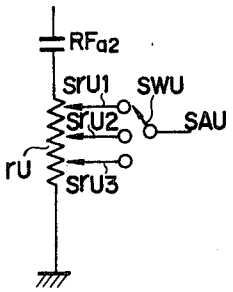

FIG. 5 shows a modification of the variable resistor shown in FIG. 4 which is adapted to adjust the dividing ratio in dependence upon the prevailing traffic demand condition. In this figure, only the variable resistor *r*U serving for setting the dividing ratio for the number of the passengers awaiting the lifting cars is shown. In this embodiment, it is contemplated that the terminals $srU_1$ to $srU_2$ of the variable resistor are previously set at the positions corresponding to the dividing ratios required at the morning office hour band, during the normal traffic period and the evening office hour band, for example, and one of the terminals may be selected by a change-over switch SWU in dependence upon the relevant hour band. Of course, the means for adjusting the dividing ratio dependent on the traffic demand conditions is not restricted to the arrangement shown in FIG. 5. Other methods may be employed for the same purpose without departing from the principle of the present invention.

As will be apparent from the above description, the invention provides an arrangement which always assures an appropriate detection of the number of the passengers awaiting at the hall for each of the lifting and the lowering directions. With the aid of the traffic information available from the inventive arrangement, an elevator control with high accuracy and flexibility can now be attained with consideration being paid to the number of the passengers awaiting the cars at the hall grouped for each of the directions of destinations intended by the passengers. Consequently, the operation or running efficiency of the elevator system as well as service for the passengers are remarkably enhanced.

Before entering into the discussion of the elevator control with the aid of the information about the number of the passengers classified by their destinations as above described, another embodiments of the apparatus for detecting the number of the awaiting passengers for each of the directions of their destinations will be described by referring to FIGS. 6 to 8.

In this embodiment of the detection apparatus according to the invention, the number of the passengers getting into the car is constantly and sequentially detected and stored for each of the transporting directions of the car, and the ratio between the numbers of the passengers getting into the cars in the different directions is computed from time to time on the basis of the stored antecedent record. Additionally, the number of the passengers getting into the car for each of the transporting directions which may vary in dependence upon the traffic demand conditions such as those in the normal traffic period, lunch hour band or the like is also exchangeably stored.

Figure 6:
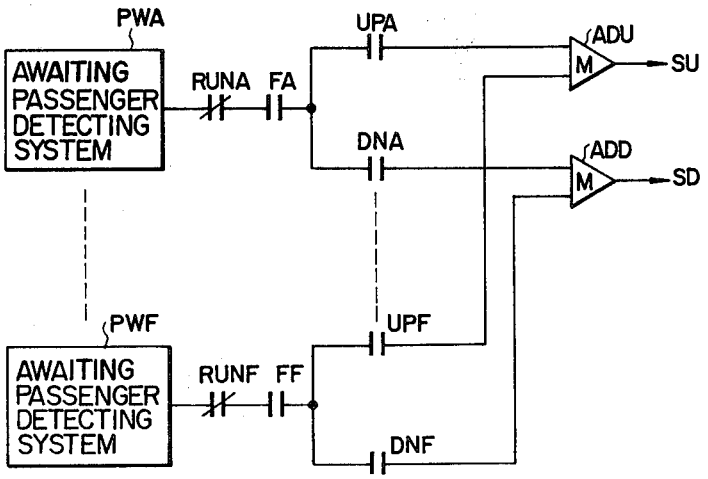
Figure 7:
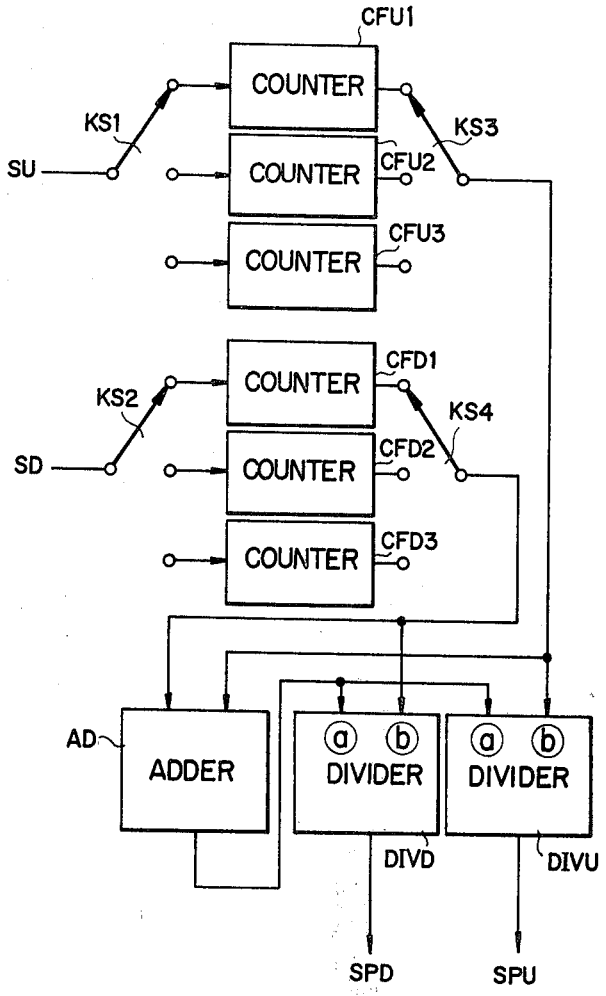
Figure 8:
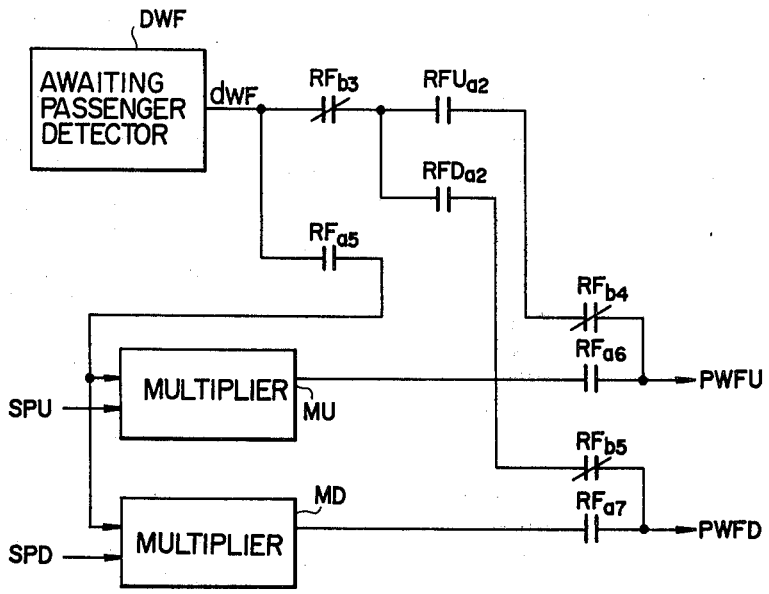

It is to be noted that the embodiment shown in FIGS. 6 to 8 is applied to the elevator system such as shown in FIG. 1 where six cars A to F are disposed in juxtaposition to one another at the Fth floor. Similar circuit or apparatus should be provided for every floor.

FIG. 6 shows a circuit for detecting the number of the passengers getting into the car for each of the transporting directions. Reference symbols in the drawing indicate the following units;

PWA–PWF: detection systems installed in each of the cars A to F for detecting the number of the passengers getting into the associated cars. For example, this detection system may be composed of the light transmitters and the photo-receivers disposed at the entrance of the car as hereinbefore described in conjunction with FIG. 1 and the counter circuit shown in FIG. 2 for counting the passengers getting into the car. Alternatively, the detection of the number of the passengers may be effected by comparing the number of the passengers remaining in the car after the getting off the other passengers at the landing time of the car at a floor with the number of the passengers within the car after the getting in of the passengers from the above floor before the starting of the car. At any rate, any means may be employed which can detect the number of the passengers getting into the car.

RUNA-RUNF: contacts closed when the associated cars stop.

FA–FF: contacts closed when the cars A to F are positioned at the Fth floor.

UPA–UPF: contacts adapted to be closed during the lifting of the associated cars A to F.

DPA–DPF: contacts adapted to be closed when the associated cars A to F are lowered.

ADU, ADD: adders

Assuming by way of example that the car A stops at the Fth floor in the up or lifting direction, the detection signal from the detector PWA representative of the number of the passengers getting into the car A is transmitted through RUNA, FA and UPA and applied to the adder ADU at the input thereof which is also applied with the similar signals representing the number of passengers getting into other cars. In this manner, the adder ADU adds together the numbers of all the passengers got into the cars topped at the Fth floor in the lifting movement thereof and produces a signal SU representing the summed number of the passengers. Similarly, the adder ADU odds together the numbers of all the passengers gotten into the cars from the Fth floor in the lowering movement thereof and produces a corresponding signal SD. After the departure of the cars, inputs to the adders ADU and ADD will disappear, whereby the output signal values of the adders are reset to zero.

Referring to FIG. 7 which shows a circuit for computing the aforementioned dividing ratio, reference symbols used therein designate the following elements;

$KS_1$–$KS_4$: change-over switches actuated depending on the traffic demand conditions such as at the normal traffic hour band, lunch hour band or the like.

$CFU_1$–$CFU_3$: counters provided for every traffic condition to count and store the number of thepassengers getting into the cars running in the up-direction.

$CFD_1$–$CFD_3$: counters provided for every traffic condition to count and store the number of the passengers getting into the car running in the down-direction.

AD: adder

DIVD and DIVU: dividers for diving a signal at the input terminal ⓑ by a signal at the input terminal ⓐ.

In the state shown in FIG. 7, upon the application of the signals SU and SD representing the number of the passengers got into the cars from the circuit shown in FIG. 6, the counters $CFU_1$ and $CFD_1$ count the signals and store therein. The outputs from the counters $CFU_1$ and $CFD_1$ are added together at the adder AD. Additionally, the outputs of the counters $CFU_1$ and $CFU_2$ as well as the output signal from the adder AD are transmitted to the divider circuits DIVU and DIVD. Assuming that the contents stored in the counters $CFU_1$ and $CFD_1$ are represented by CCU and CCD, respectively, the output of the adder AD is represented by CCU + CCD, whereby the output signal SPU from the divider circuit DIVU can be expressed by CCU/(CCU + CCD), while the output signal SPD from the divider DIVD can be given by CCD/(CCU + CCD). In this manner, the dividing ratio for the number of the passengers for each of the transporting directions can be determined by the computation on the basis of the antecedent numbers of the passengers got into the lifting and the lowering cars which numbers are stored in the counters $CFU_1$ and $CFD_2$, respectively. The signals SPU and SPD represent the dividing ratios for the numbers of the passengers awaiting the lifting and the lowering cars, respectively, at the Fth floor.

The switches $KS_1$, $KS_2$, $KS_3$ and $KS_4$ are interlocked with one another and can be changed over to the counters $CFU_1$–$CFU_2$ and $CFD_1$–$CFD_3$. In this connection, the traffic demand condition in a day may be classified, for example, into the conditions at the beginning of the office hours, during the normal traffic period and at the end of the office hours. Then, the switches $KS_1$ and $KS_3$ may be changed over to the counter $CFU_1$ at the beginning of the office hours, to the counter $CFU_2$ during the normal traffic hour and to the counter $CFU_3$ in the evening, while the switches $KS_2$ and $KS_4$ may be switched to the counters $CFD_1$, $CFD_2$ and then $CFD_3$ in a similar manner. The counters $CFU_1$ and $CFD_1$ can thus count the numbers of the passengers got in the lifting and the lowering cars, respectively, at the beginning of the office hours and the available signals SPU and SPD represent the aforementioned dividing ratios for the numbers of the passengers who are going to get into the lifting and the lowering cars. The same is the case for the other counters and the signals SPU and SPD derived therefrom represent the corresponding division ratios at the associated traffic conditions.

In the foregoing, it has been assumed that three counters are provided for each of the up- and down-directions, whereby the operations of the counters can be effected in three different modes. However, it should be appreciated that more than three counters may be provided with the traffic demand condition being classified into a corresponding number of conditions at different hour bands, to thereby produce a corresponding number of the dividing ratios.

FIG. 8 shows a circuit for detecting the number of the passengers for each of the directions of their destinations on the basis of the dividing ratios obtained by the circuit shown in FIG. 7. In FIG. 7, reference symbols MU and MD denote multipliers, while the other symbols designate the same components as those shown in FIG. 4.

Assuming now that the generation of the hall calls for the both directions is detected by the circuit shown in FIG. 3 and the relay RF is thereby turned on, the detection signal dWF from the circuit for detecting the number of awaiting passengers at the hall is then transmitted to the multipliers MU and MD which have other inputs applied with the signals SPU and SPD, respectively, which are produced by the circuit shown in FIG. 7 and represent the dividing ratios. The outputs from the multipliers MU and MD are then equal to SPU × dWF and SPD × dWF, respectively. In other words, the number of all the passengers awaiting the cars at the hall is thus divided into the numbers of the passengers for the lifting and the lowering cars in accordance with the dividng ratios, and corresponding output signals PWFU and PWFD are thereby produced. When the hall call only for one direction is produced, the detection signal *d*WF from the detector circuit DWF is output as the signal PWFU or PWFD representing the number of the awaiting passengers associated with the above hall call.

In the embodiments described above, the dividing ratios relevant to the prevailing traffic demand conditions are computed from the antecedent information as stored to thereby determine the number of the passengers for each of the directions of their destinations.

When the dividing ratios are computed on the basis of the antecedent information as mentioned above, the antecedents over a very long time span are taken into consideration in the computation. The systems described in the foregoing can accordingly provide advantages, when they are installed in the building wherein the variation in the number of passengers utilizing the elevator is inappreciable or negligible. However, in case of the buiding in which remarkable variations in the population often take place, the hitherto antecedents unsuited to the prevailing condition will exert adverse influence to the calculation of the appropriate dividing ratios.

Figure 9:
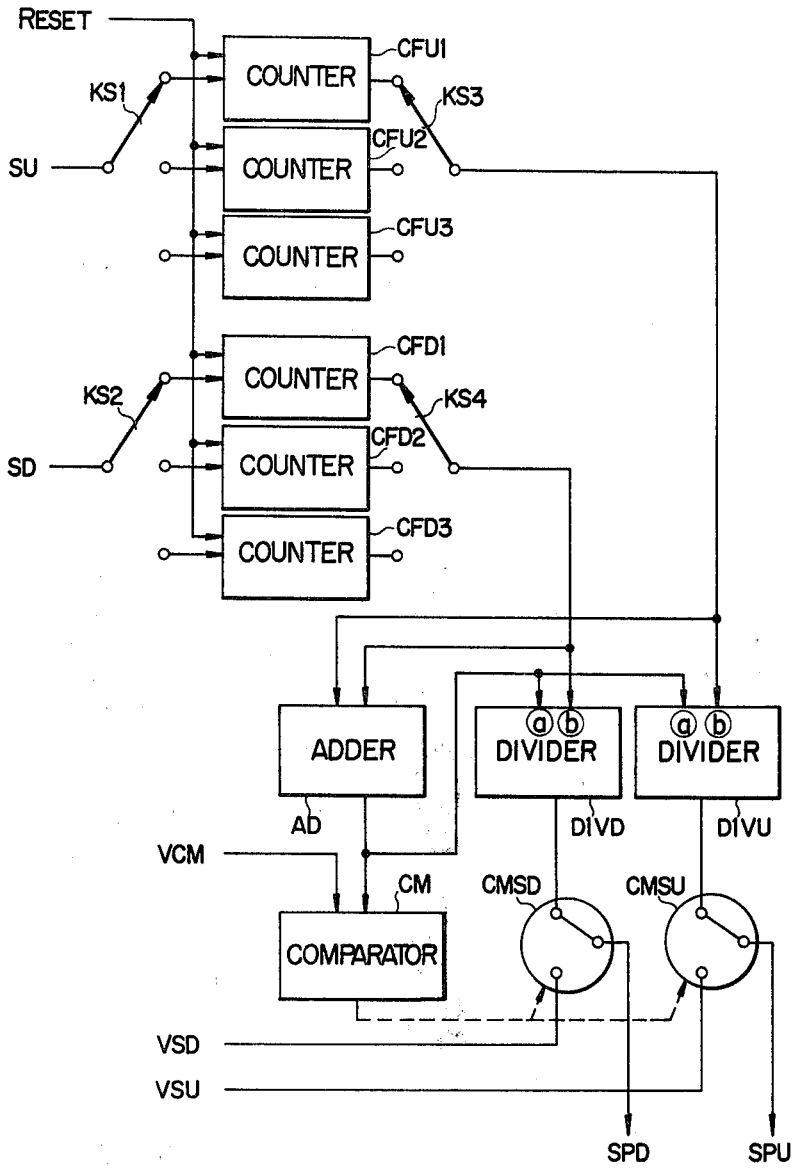
FIG. 9 shows a modification of the circuit shown in FIG. 7.

FIG. 9 shows a modification of the division ratio calculating circuit shown in FIG. 7 designed in consideration of the above situation. In the embodiment shown in FIG. 9, a comparator CM and switching relays CMSU and CMSD are added to the circuit arrangement shown in FIG. 7. Further, there are utilized additional input signals such as a reset signal RESET for clearing the stored contents of the counters $CFU_1$ to $CFU_3$ and $CFD_1$ to $CFD_3$, a comparison signal voltage VCM to be compared with the output of the adder AD and preset signals VSU and VSD representing the dividing ratios for the up- and down-directions.

In the circuit shown in FIG. 9, arrangement is made such that the antecedent information which becomes unsuited due to variations in the population of the passengers using the elevator can be cancelled by resetting the counters $CFU_1$ to $CFU_3$ and $CFD_1$ to $CFD_3$. With such arrangement, the counters $CFU_1$ to $CFU_3$ and $CFD_1$ to $CFD_3$ can store the antecedents suited to the prevailing situation for the production of correct dividing ratios. The reset signal RESET may be applied to the circuit for every constant period such as for every month or year, or when variation in the population of the passengers happens, or when the count values stored in the counters $CFU_1$ to $CFU_3$ and $CFD_1$ to $CFD_3$ reach a predetermined value.

When the output signal from the adder AD remains at a low level, a high reliability in the signals from the counters may not be assured. To dispose of such situation, the comparator CM is provided for comparing the output signal from the adder AD with the reference signal VCM. So long as the output signal from the adder AD remains lower than the reference signal VCM, the switching relays CMSU and CMSD are changed over from the divider circuits DIVD and DIVC to the signals VSD and VSU representing the present dividng ratios. In this way, the preset signals VSU and VSD are output from the circuit as the signals SPU and SPD representing the dividing ratios, so far as the reliability in the counter signals remains low.

The preset signals VSD and VSU representing the dividing ratios should be selected in dependence on the characteristic conditions of the respective floors. The changing-over to the preset signals VSD and VSU may be carried out in accordance with he traffic demand conditions.

With the circuit arrangement shown in FIG. 9, it is possible to compute or calculate the appropriate dividing ratios even when there happens a considerable variation in the population of the users of elevators, which in turn results in the improvement in the accuracy for the detection of the number of the awaiting passengers for each of the directions of their destinations.

Now, the elevator control wherein the traffic information concerning the numbers of the passengers for the lifting and the lowering cars is utilized will be described in the following.

For the convenience' sake, description will be made with reference to a simplified case in which three elevator cars A, B and C are adapted to service for the first to tenth floors.

Figure 10:
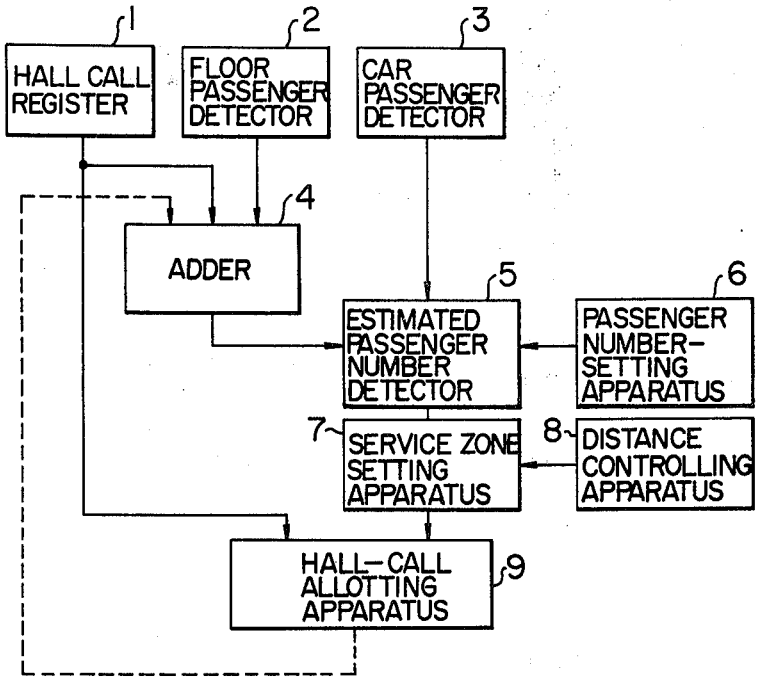
FIG. 10 is a block diagram of an elevator control apparatus embodying the principle of the invention in which the number of the car awaiting passengers for each of the directions of their destination is utilized as a traffic information.

FIG. 10 shows in a block diagram an exemplary embodiment of the elevator control system according to the invention in which the numbers of the awaiting passengers classified in dependence upon the directions of their destination produced in the above described manners are utilized for the control of the elevator cars.

In FIG. 10, reference numeral 1 designates a hall call registration apparatus and 2 indicates the detector apparatus for detecting the number of the passengers for each of the directions of their destinations. These apparatus 1 and 2 are installed at every floor. Units denoted by numerals 3 to 8 are provided for each of the cars. It is assumed that the units 3 to 8 are to be mounted on the car A. The unit 3 is an apparatus for detecting the number of the passengers in the car A, 4 is an apparatus for adding the number of the awaiting passengers allotted for the direction of the hall call, 5 is an apparatus for detecting the estimated number of the passengers getting into the car, 6 is an apparatus for setting a restriction to the number of the passengers to be transported, 7 is an apparatus for setting service zones, and 8 is an apparatus for controlling the distances among the cars. Finally, numeral 9 indicates an apparatus for allotting a hall call to one of the cars in dependence upon the signal from the service zone setting apparatus 7.

In the first place, operations of the service zone setting apparatus 7 and the hall call allotting apparatus 9 will be briefly described with reference to FIG. 11. In the presumed case wherein the cars A, B and C are adapted to service the first to the tenth floors, it is again assumed that the car A passes by the second floor in the upward movement and the car B is at the tenth floor in the downward movement, while the car C passes by the fifth floor in the lowering movement. The service zones of the concerned individual cars cover the ranges between the position of the concerned cars and the floor at which the preceeding cars are positioned, namely the ranges indicated by the lengths of the arrows shown in FIG. 11. In the illustrated state, when the hall calls for the up-direction and the down-direction are produced from the eighth floor and the seventh floor, respectively, for example, then the hall call for the up-direction from the eighth floor is allotted to the car A and the hall call for the down-direction. In other word, the term "service zone" mean the range in which the car can respond to the hall call. The service zone setting apparatus 7 serves to set the above mentioned service zone for the car A, while the hall call allotting apparatus 9 is operative to allot the produced hall call to the car running in the service zone to which the hall call belongs. The range of the service zone set by the apparatus 7 can be adjusted in accordance with the signal from the intercar distance control apparatus 9, which will be described hereinafter in more detail in connection with an embodiment.

When the hall call registration apparatus 1 is actuated, the hall call produced thereby is transmitted to the hall call allotting apparatus 9 which responds thereto for allotting the hall call to the car having the service zone covering the floor from which the above hall call is produced in accordance with the information of the signal from the service zone setting apparatus 7. When the car provided with the aforementioned units 3 to 8 is allotted with the hall call, the allotting signal is fed to the apparatus 4 for adding the number of the awaiting passengers for the direction of the allotted hall call, whereby the adder apparatus 4 becomes in the position to be applied at the input thereof with the signals from the hall call registration apparatus 1 and the detection apparatus 2 for detecting the number of the passengers awaiting at the floor from which the hall call is produced, to thereby add the above number to the number of the passengers awaiting at the other floors which have been already allotted to the car. In the meantime, the number of the passengers in the car is detected by the detector apparatus 3. The detector 5 for determining the estimated number of the passengers then receives the signal representing the number of the passengers in the car produced by the detector 3 and the signal representative of the number of the awaiting passengers at the allotted floors and adds together these two signals to thereby determine the estimated number of all the passengers to be transported by the car. The signal representing the estimated number is subsequently compared with the signal from the setting apparatus 6 representing the restriction imposed on the number of the passengers to be carried by the car. If the estimated number is greater than the restricted number, a corresponding information is supplied to the service zone setting apparatus which responds thereto for restricting the service zone of the concerned car and thereafter limits the allotment of the hall calls to the car. The restriction of the service zone may be effected by cutting off the corresponding portion or narrowing the width of the zone.

From the above brief description, it will be understood that, according to the elevator control embodying the principle of the invention, the estimated number of the passengers to be carried by the car can be previously detected by utilizing the novel traffic information concerning the numbers of the passengers awaiting at the hall classified by the directions of their destinations. On the basis of the estimated number of the passengers, the possibility of no vacancy can be previously detected, which in turn allows the restriction on the allotment of the hall calls to thereby enhance the flexibility in the control of the elevator system.

In the following, the elevator control apparatus schematically illustrated in FIG. 10 and generally mentioned above will be described in detail by referring to FIGS. 12 to 24 which show a practical embodiment of the control apparatus according to the invention.

FIG. 12 shows a circuit diagram of a detector circuit for detecting the spatial distance between the cars. The circuit shown in FIGS. 12 is designed for the car A to detect the distance between it and the succeeding car. The same circuit is necessarily provided for each of the cars. The reference symbols in FIG. 12 indicate the following matters;

F1UA–F9UA: location signals of the car A produced at the first to ninth floors during the lifting movement.

F2DA–F10DA: location signals of the car A produced at the second to tenth floors during the lowering movement.

F1UB–F9UB: corresponding location signals of the car B during the lifting movement.

F2DB–F10DB: corresponding location signals of the car B during the lowering movement.

F1UC–F9UC: corresponding location signals of the car C during the lifting movement.

F2DC–F10DC: corresponding location signals of the car C during the lowering movement.

01UA1–09UA2, 02DA1–010DA2: OR elements

I1UA–I9UA, I2DA–I10DA: inhibit elements

*r, ro:* resistors

*da:* signal representing the distance between the car A and the succeeding car

As is illustrated in FIG. 12, the elevator service floors are operatively coupled to one another in an endless loop of F1U–F2D–F3D . . . F9D–F10D–F9U–F8U . . . F2U–F1U and the location signals of the car A are transmitted sequentially therethrough until the signals have been interrupted by the location signals of the car B or C. At that time, the signal da corresponding to the spatial distance can be obtained from the signals produced at all the floors through the resistors *r* and *ro.*

In more detail, it is assumed that the car A is at the eighth floor in the lifting direction, the car B is located at the second floor also in the lifting direction and the car B is at the fifth floor in the lowering direction. In this case, the car following the car A is the car B. The location signal F8UA of the car A is then transmitted through the path of F8UA–08UA1–I8UA–07UA1 . . . I3UA–02UA1–I2UA. However, because the location signal F2UB of the car B is 1 and transmitted through F2UB and O2UA2 to I2UA to thereby inhibit the latter, the output of the inhibit element I2UA is logically 0, the transmission of the location signal F8UA of the car A is interrupted by the inhibit element I2UA.

On the other hand, the output signals of the inhibit elements I8UA, I7UA . . . I4UA and I3UA are 1, there appear signals corresponding to the location signals of the associated six floors across the resistor *ro* through the resistor *r* connected to the above inhibit elements, which signals constitutes the signal *da.* If the values of the resistors *r* and *ro* are so selected that $r >> ro$, the signal appearing across the resistor *ro* will be proportional to the number of the floors.

Referring to FIG. 13 showing a circuit for detecting the number of the hall calls in response to which the car A is to be stopped, symbols Ry1UA1–Ry9UA1 and Ry2DA1–Ry10DA1 represent contact signals for the contacts which are closed when the hall calls are allotted to the car A, as will be described hereinafter in conjunction with FIG. 20. Similar circuit is provided for each of the cars. By means of this circuit, a voltage CA which is proportional to the number of the produced calls can be obtained through resistors *rl* and *ro* in the same manner as in the case of FIG. 12. Although the number of the hall calls in response to which the car is to be stopped is detected in this embodiment, it is preferred to receive the cage calls additionally to thereby detect the number of all the calls to stop the car.

Figure 14:
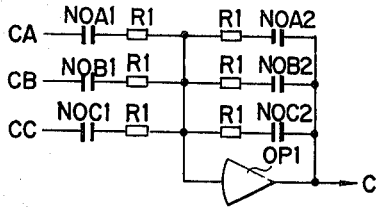

FIG. 14 shows a circuit for adding together the numbers of calls of all the cars to calculate therefrom an averge number of calls for a car. In this figure, symbols CA, CB and CC indicate the numbers of the calls to stop the cars A, B and C, respectively, which can be produced by the circuit such as shown in FIG. 13, while symbols N0A1;N0A2, N0A2, N0B1;N0B2 and N0C1, N0C2 denote contacts which are opened when the cars A, B and C are operatively disconnected from the operation under the supervisory control. Symbols R1 indicate operational resistors and 0P1 an operational inverter amplifier.

Assuming that all the cars A, B and C are driven under the supervisory control, the contacts N0A1 to N0C2 are then all in the closed states. If the number of calls for the cars A, B and C to be stopped are represented by CA, CB and CC, respectively, the output C of the operational amplifier 0P1 can be given by the following expression.

$$C = \frac{-\frac{R_1}{3}}{R_1}(CA+CB+CC) = -\tfrac{1}{3}(CA+CB+CC) \quad (1)$$

When the car A is disconnected from the supervisory control operation, the output C of the operational amplifier can be expressed as follows;

$$C = -\frac{\frac{R_1}{2}}{R_1}(CB+CC) = -\tfrac{1}{2}(CB+CC)$$

From these expressions, it follows that the output C of the operational amplifier 0P1 represents a value corresponding to the averaged number of the calls for all the cars under the supervisory control.

Figure 15:
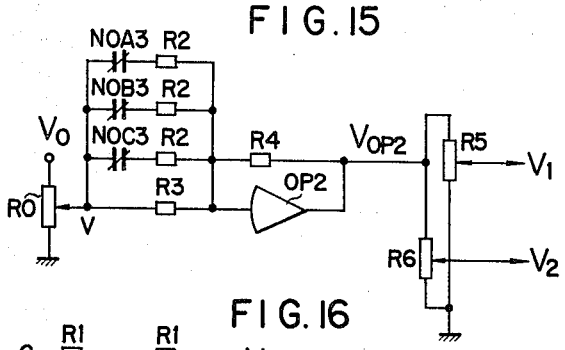
Figure 16:
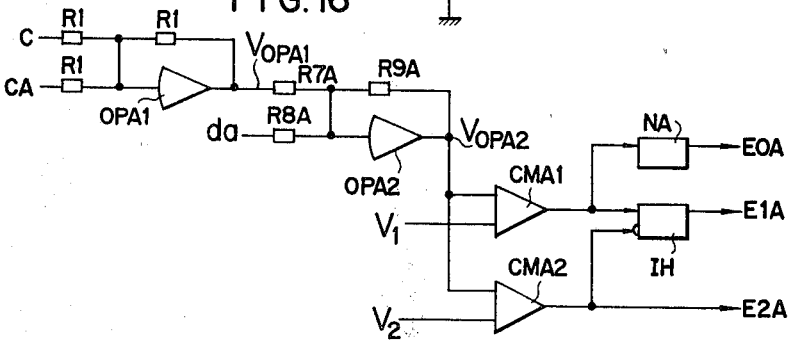

FIG. 15 shows a circuit for producing a reference or comparison voltage for the comparator circuit shown in FIG. 16. When the cars A, B and C are under the supervisory control operation, contacts N0A3, N0B3 and N0C3 are opened. The output of an operational amplifier 0P2 in FIG. 15 is then given by the following expression.

$$V_{op2} = \frac{-R_4}{R_3}(-V) = \frac{R_4}{R_3}.V$$

By appropriately selecting the values of resistors R3, R4 and R0, the output $V_{op2}$ may be made equal to 6V. If the car B is excruded from the supervisory control operation, the contact N0A3 is opened, whereby the output voltage of the operational amplifier 0P2 can be given as follows;

$$V_{op2} = -\frac{R_4}{R_3}(-V) = R_4V\left(\frac{1}{R_3} + \frac{1}{R_2}\right) \quad (2)$$

By selecting a suitable value for the resistor R2, the output voltage $V_{op2}$ can be made equal to 10V. When the output voltage of the operational amplifier is divided appropriately by variable resistors R5 and R6, reference voltages $V_1$ and $V_2$ for the comparator can be obtained. In case $V_{op2}$ is equal to 6V, the outputs $V_1$ and $V_2$ may be 5V and 4V, respectively, and, at $V_{op2}$ of 10, $V_1$ and $V_2$ may be 8.3V and 6.6V, respectively.

FIG. 16 show a circuit to determine time interval or the distance on the time base for the car A, which circuit is supplied with inputs from the circuits shown in FIGS. 12 to 15. This circuit is provided also for each of the elevator cars. In FIG. 16, reference letters indicate the following matters;

0PA1–2: operational amplifiers

CMA1–2: comparators each being adapted to produce output 1 when sum of two inputs thereto is equal to zero or of positive polarity.

NA: NOT element

IH: inhibit element

E0A–E2A: time interval determining signals containing instructions to advance the car A from the actual location to other locations in appearance. For example, the signal E0A is to advance the car A to the zero-floor, E1A to the first floor and E2A to the second floor.

The number of calls CA for which the car A is to be stopped and which is produced from the circuit shown in FIG. 13 and the average call number C available from the circuit shown in FIG. 14 are combined at the operational amplifier 0PA1, the output $V_{opA1}$ can be expressed as follows;

$$V_{opA1} = -(CA + C) = -CA + \tfrac{1}{3}(CA + CB + OC) \quad (3)$$

In a similar manner, the output of the operational amplifier is given by $$V_{opA2} = -\frac{R_{9A}}{R_{7A}}.V_{opA1} - \frac{R_{9A}}{R_{8A}}.da \quad (4)$$

By selecting suitable values for the ratios of $R_{7A}$, $R_{8A}$ and $R_{9A}$, the spatial distance of car corresponding to one floor may be expressed by 1 volt, while a single call may correspond to about 3 volts. Stated in another way, the time interval between the car can be calculated by selecting appropriately the weights for the spatial distance of the car and the weights for the calls. The equation (4) can be rewritten as follows;

$$V_{opA2} = -K_1\left(-CA + \frac{CA+CB+CC}{3}\right) - K_2 \cdot da$$
$$= K_1 \cdot CA - \frac{K_1}{3}(CA + CB + CC) - K_2 \cdot da \quad (5)$$

As will be appreciated from the above equation (5), when the call number CA for stopping the car A is equal to the average call number C, the first and the second terms of the equation (5) also become equal to each other, whereby the above equation can be reduced to $V_{opA2} = -K_2.da$. On the other hand, if the call number CA for the stoppage of the car A is greater than the average call number C for one unit, $$K_1 \cdot CA - \frac{K_1}{3}(CA + CB + CC) = 3 \text{ volts.}$$

To the contrary, in case the call number CA for the stoppage of the car A is smaller than the average call number C for one unit, $$K_1 \cdot CA - \frac{K_1}{3}(CA + CB + CC)$$

is equal to −3 volts.

In this manner, the spatial distance of the cars can be obtained in terms of the time interval in which the call numbers are also considered as determinants.

Now, assuming that the distance between the car A and the succeeding car corresponds to six floors and that the call number CA for the stoppage of the car A is greater than the average call number C by a single unit, $V_{opA2} = +3V - 6V = -3V$, wherein V represents voltage in volts. When the reference voltages $V_1$ and $V_2$ for the comparators CMA1 and CMA2 are set to 5V and 4V, respectively, the comparator CMA1 will output the signal 1 from the inputs of −3V and 5V. The comparator CMA2 also produces output 1 from the combination of −3V and 4V at the inputs thereof. Consequently, the signal value of the time interval determination signal E2 is 1. The signal E1A is zero, since the inhibit element IH is disabled. The signal E0A is also 0 due to the output 0 of the NOT element NA.

When $V_{op.A2} = -5V$, the output of the comparator CMA1 is 1 with the inputs of −5V and 5V, while the output of the comparator CMA2 is 0 because of its inputs of −5V and 4V. In this manner, the time interval between the cars are determined by the comparators CMA1 and CMA2, whereby the time interval determination signals E0A to E2A are produced.

Figure 17:
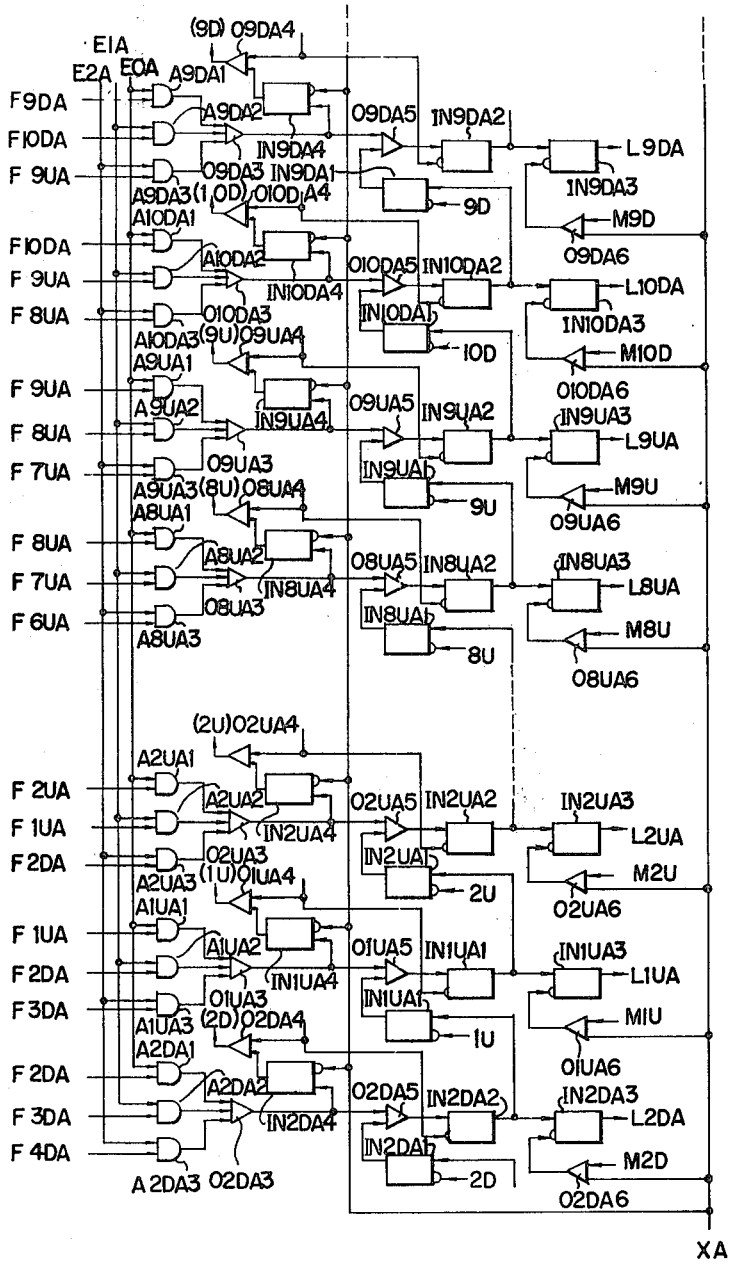
Figure 18:
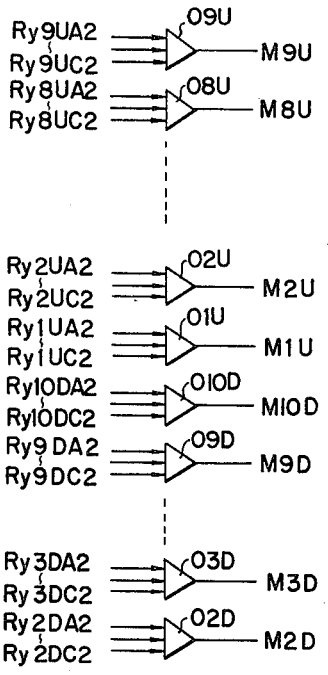
Figure 19:
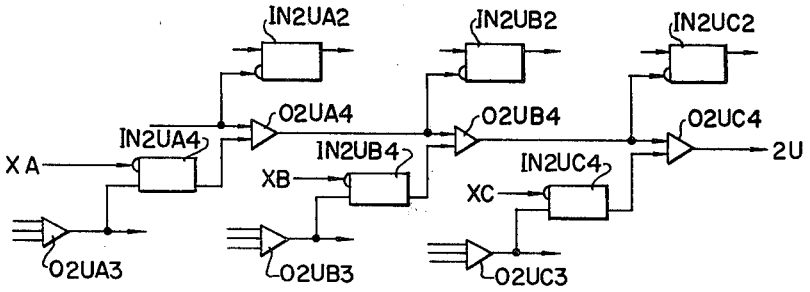

FIGS. 17 to 19 show an arrangement of a circuit which serves to set the service zone for the car A in dependence upon the aforementioned location signals, the time interval determination signals of the car A and a car-full or no vacancy predicting signal XA produced by an apparatus constituting a characteristic feature of the present invention. Similar circuit is provided for each of the cars.

In the drawings, reference characters indicate the following matters;

A1UA1–A9UA3, A2DA1–A10DA3: AND elements
01UA3–09UA6, 02DA3–010DA6: OR elements
IN1UA1–In9UA4, IN2DA1–IN10DA4: inhibit elements
IU–9U, 2D–10D: output signals of a priority order setting circuit shown in FIG. 19.
M10–M9U, M2D–M10D: output signals from an inhibit signal generation circuit shown in FIG. 18.
L1UA–L9UA, L2DA–L10DA: service zone signals coupled to the circuit shown in FIG. 20.

Assuming again that the elevator system is in the state shown in FIG. 11 in which the car A is at the second floor in the up-direction with the preceeding car B located at the tenth floor in the down-direction, while the car C is at the fifth floor in the down-direction, description will now be made to the case in which the time interval determination signals are produced both for the cars A and B.

If the car-full predicting signal XA is taken out of consideration, the output signal of the AND element A2UA1 is 1 due to the fact that the car A is located at the second floor and that the time interval determination signal E0A is 1. The output signal 1 of the AND element A2UA1 is transmitted through the elements 02UA3, 02UA5, IN2UA2, IN2A3 and L2UA in this order. The signal from the inhibit element IN2UA2 is fed to the inhibit element IN3UA1 (not shown) for the third floor and sequentially transmitted through the corresponding inhibit elements for the fourth to the seventh floors. The signal from the inhibit element IN7UA2 for the seventh floor is input to the inhibit element IN8UA1 and thereafter transmitted sequentially through the elements 08UA5, IN8UA2, IN9UA1, 09UA5, IN9UA2 and IN10DA1 in this order, as a result of which the output signals L2UA–L9UA of the inhibit elements IN2UA3 to IN9UA3 become 1 to constitute the service zone signals coupled to the circuitry shown in FIG. 20. On the other hand, the signal from the OR element 02UA3 is fed to the inhibit element IN2UA4 and transformed to the signal 2U by the priority order setting circuit shown in FIG. 19. The single input to the OR element 02UA4 for the car A is provided by the signal from the inhibit element In-2UA4. No other inputs are applied to the OR element 02UA4. The output of the 0R element 02UA4 is coupled to the 0R element 02UB4 and the inhibit element IN2UB2 for the car B, while the output from the 0R element 02UB4 is supplied to the elements 02UC4 and IN2UC2 for the car C. The output signal from the 0R element 02UC4 gives rise to the generation of the signal 2U which in turn is applied to the inhibit elements IN2UA1, IN2UB1 and IN2UC1 as the inhibit inputs thereto, as is shown in FIG. 17.

In this manner, the signals of every cars are assigned with priorities in the order of A, B and then C and inhibit the inhibit elements IN2UA2, IN2UB2 and IN-2UC2 of the service zone setting circuits of the respective cars. In more particular, the signal 1 from the 0R element 02UA3 of the car A generates the signal 2U which inhibits the inhibit elements IN2UA1 to IN2UB1 of the service zone setting circuits of the respective cars. In this operation, the input signal to the inhibit element IN2UC1 of the car C is inhibited to produce the input 0.

Since the car B is located at the tenth floor in the down-direction, the signal 10D is logically 1 to inhibit the inhibit element IN10DA1 of the car A which thus produces the output 0, whereby output signals L2UA to L9UA of the inhibit elements IN2UA3 to IN9UA3 are caused to be 1 and the service zone is defined between the second and the ninth floors in the up-direction.

Figure 11:
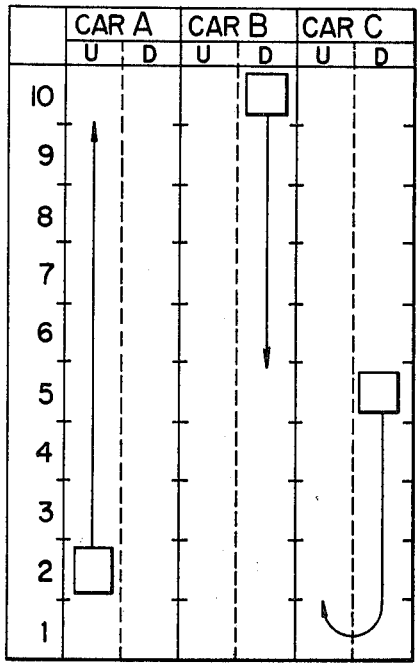
FIG. 11 illustrates the manner in which the service zones are set for every car so that the car may respond to any hall call produced in the associated zone.

With the car-full predicting signals XB and XC taken out of consideration, the service zones for the cars A, B and C are defined, respectively, between the second and the ninth floors in the up-direction, between the tenth and the sixth floors in the down-direction, and between the fifth and the second floors in the down-direction plus the first floor in the up-direction, as illustrated in FIG. 11. The service zone signals L2UA to L9UA, L10DB to L6DB, L5DC to L2DC and L1UC thus take logic 1 level and are transferred to the circuit shown in FIG. 20.

Figure 20:
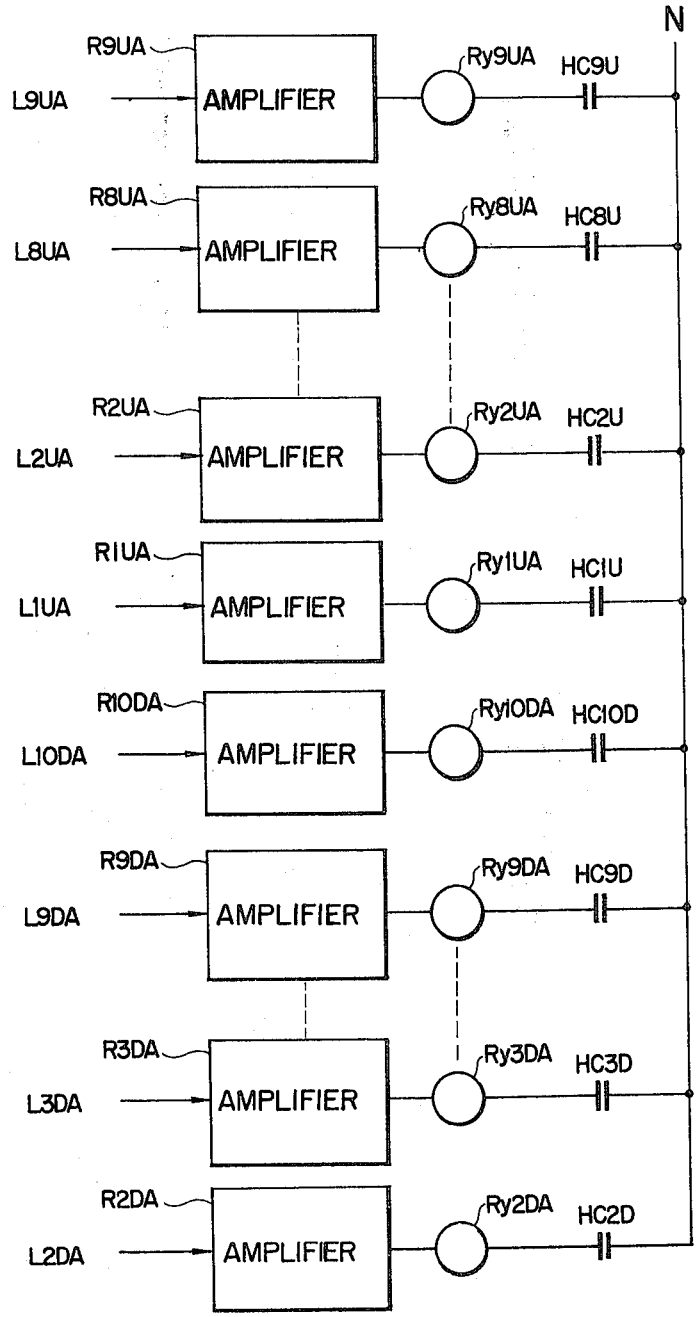

FIG. 20 shows an arrangement of the circuit for allotting the hall call to the car A. Symbols R1UA to R9UA and R2DA to R10DA denote amplifier elements each having the self-holding function, R*y*1UA to R*y*9A and R*y*2DA to R*y*10DA are relays which are turned on when the hall call is allotted to the car A, and HC1U–HC9U as well as HC20–DC10D designate contacts of relays which remain in the energized state until the hall call has been registered and serviced.

Assumption is made that the car A has the service zone defined between the second and the ninth floors in the up-direction and the hall call HC8U for the up-direction is produced from the eighth floor when the signals L2UA to L9UA are 1. Then the signal L8UA becomes also 1 and the relay R*y*8UA is turned on through the path formed by L8UA, R8UA, R*y*8UA, HC8U and C due to the now closed contact for the signal HC8U, whereby the hall call for the up-direction from the eighth floor is allotted to the car A.

Since the amplifier element R8UA has the self-holding function, the relay R8UA continues to be on until the car A has serviced the hall call for the up-direction produced from the eighth floor. The relay R*y*8UA provides input signal R*y*8UA2 to the OR element O8U of the inhibit signal generation circuit shown in FIG. 18 to thereby produce the output signal M8U of 1 from the OR element. The indhibit signal M8U is applied to the input of the OR element 01UA6 of the circuit shown in FIG. 17 to produce therefrom the output signal of 1, whereby the output signal L8U8 of the inhibit element IN8UA3 is turned to 0. In a similar manner, the inhibit signal M8U inhibits the inhibit elements IN8UB3 and IN8UC3 (not shown) for the cars B and C. In this manner, the cars other than the car A are prevented from responding to the hall call for the up-direction from the eighth floor. When the hall call for the down-direction is produced at the tenth floor, the signal L10DA remains at 0, since the tenth floor is not covered by the service zone of the car A. Accordingly, even if the relay contact HC10D is closed, the relay Ry10DA is not energized so that the above hall call is not allotted to the car A.

The signals from the relays Ry1UA to Ry9UA and Ry2DA to Ry10DA provide input signals Ry1UA1 to Ry9UA1 and Ry2DA1 to Ry10DA1 for the detector for detecting the hall call to stop the car such as shown in FIG. 13.

Figure 21:
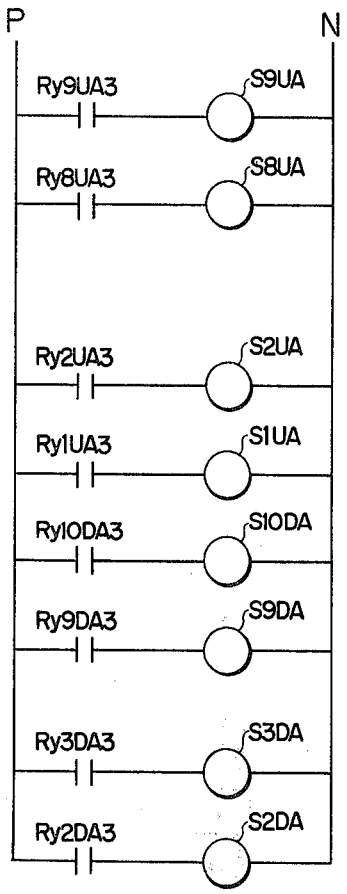

FIG. 21 shows a display circuit composed of pilot lamps S1UA to S9UA and S2DA to S10DA which are turned on by the contacts Ry1UA3 to Ry9UA3 and Ry2DA3 to Ry10DA3 of the relays Ry1UA to Ry9UA and Ry2DA to Ry10DA as energized when the associated call is allotted. The pilot lamps S1UA to S9UA and S2DA to S10DA are respectively installed at the platform of the associated floors for the car A. As the hall call is allotted to the car A, the pilot lamp at the floor from which the call is produced is energized to thereby inform the awaiting passengers that the car A is ready for servicing them. For example, when the hall call for the up-direction dispatched from the eighth hall as described above, the relay Ry8UA is energized to close its contact Ry8UA3, as a result of which the pilot lamp S8UA installed at the platform for the car A at the eighth floor.

Next, referring to FIGS. 22 and 23, a practical arrangement of the circuit for detecting the estimated number of the passengers to be carried by the car and producing the no-vacancy or half-full predicting signal XA will be described. This circuit also constitutes a novel feature of the system according to the invention. The car-full predicting signal XA is input to the service zone setting circuit shown in FIG. 17.

Figure 22:
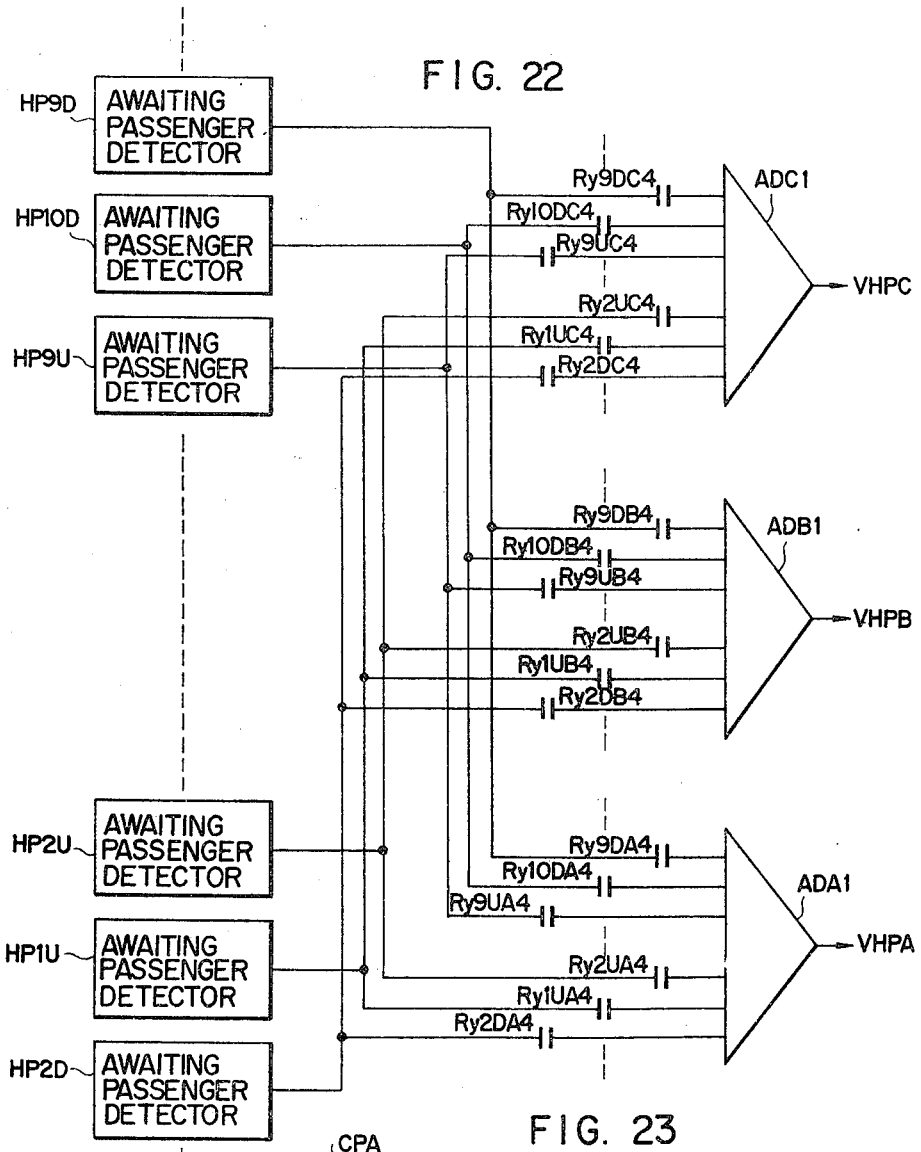

FIG. 22 shows a circuit for adding the number of the passengers for each of the cars in dependence upon the directions of the hall calls as allotted. Symbols HP1U to HP9U and HP2D to HP10D represent the hereinbefore described detection circuits for detecting the number of passengers for each of the directions of their destinations according to the principle of the present invention. In FIG. 22, the detection circuits are separately illustrated for every direction. However, it will be appreciated that the detection circuits for the same floor are constructed for the integral detection, as described hereinbefore. The outputs of the detection circuits for detecting the number of the awaiting passengers for each of the transporting directions, that is, the circuits HP1U to HP9U and HP2D to HP10D are coupled to adders ADA1, ADB1 and ADC1 provided for every car through the contacts Ry1UA4 to Ry9UA4, Ry2DA4 to Ry10DA4 and Ry1UB4 to Ry10DB4 and Ry1UC4 to Ry10DC4, respectively, of the relays Ry1UA to Ry9UA and Ry2DA and Ry10DA of the car A shown in FIG. 20 and the relays of the cars C and D such as Ry1UB to Ry10DB and Ry1UC to Ry10UC, which relays are adapted to be closed in response to the allotment of the associated hall calls. Accordingly, th output VHPB of the adder ADA1, the output VHPB of the adder ADB1 and the output VHPC of the adder ADC1 represent voltages proportional to the sum of the numbers of the passengers allotted, respectively, for the cars A, B and C in accordance with the directions of the hall calls. The output VHPA of the adder ADA1 is coupled to the circuit shown in FIG. 23.

Figure 23:
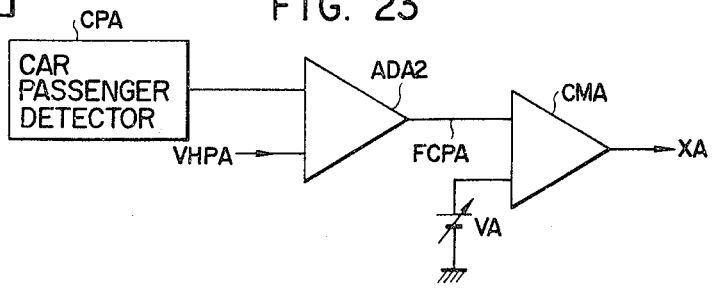

FIG. 23 shows an arrangement of the circuit which adds together the number of the awaiting passengers for the direction of the hall calls allotted to the car A and the number of the passengers actually transported by the car A to thereby detect the estimated number of the passengers to be carried by the car A and determine whether the estimated number is greater than the tolerable number of the passengers. The circuit shown in FIG. 23 is of course attached to the cars B and C. Symbol CPA represents the dectector apparatus for detecting the number of the passengers within the car A. This detector apparatus may be composed of a weighing apparartus or any other means which can produce an output signal in proportion to the number of the passengers in the car or cage A. The output signal of the detector apparatus CPA of the car A is applied to the input of the adder ADA2 together with the output VHPA of the aforementioned adder ADA1 shown in FIG. 22 and added to the output VHPA. The output from the adder ADA2 is thus a voltage signal FCPA proportional to the sum of the number of the awaiting passengers for the direction of the hall calls allotted to the car A and the number of the passengers within the cage, that is the estimated number of all the passengers to be carried by the car A. The signal FCPA is compared by the comparator CMA with the set reference voltage VA representing the allowable maximum number of the passengers. When the output signal FCPA of the adder ADA2 is smaller than the reference voltage VA, the output of the comparator CMA which constitutes the car-full predicting signal XA is 0. To the contrary, if the voltage FCPA is greater than the reference voltage VA, the ouput signal XA becomes 1. The car-full predicting signal XA is coupled to the circuit shown in FIG. 17.

In the state of the elevator system in which the car A is located at the second floor in the up-direction, the car B is at the tenth floor in the down-direction and the car C is at the fifth floor also in the down direction, wherein the time interval determination signals EO are produced by all the cars so that the service zones such as shown in FIG. 11 are assigned to the cars A, B and C, it is assumed that the estimated number of the passengers FCPA of the car A becomes greater than the allowable maximum number of the passengers VA, which thus results in the generation of the car-full predicting signal XA of the logic value 1 from the comparator CMA. This car-full predicting signal XA is applied to the inputs of the OR elements O1UA6–09UA6, O2DA6–010DA6 which are connected to the inhibit elements IN1UA3–IN9UA3, IN2DA3–IN10DA3 shown in FIG. 17. The outputs of the above OR elements becomes 1, whereby the above mentioned inhibit elements are inhibited and the output signals L1UA–L9UA, L2DA–L10DA therefrom are set to 0. Accordingly, in contrast to the case described hereinbefore in conjunction with FIG. 17, and due to the fact that the car A is located at the second floor and the signal EO is at 1 level, the output signal of 1 from the OR element O2UA3 is not transmitted to the OR element 02UA4 shown in FIGS. 18 and 19, and therefore the inhibit elements IN2UB2 and IN2UC2 as well as IN2UA1, IN2UB1 and INUC1 of the service zone setting circuit for the cars B and C are not inhibited. In other words, the car A is in appearance rid of the operation of the service setting circuit for the cars and there arises the state in which the services are performed by the two cars B and C. The car A has now no service zone. The car B has the service zone defined between the tenth and the sixth floors in the down-direction. The car C has the service zones defined between fifth and second floors in the down-direction and between the first and the ninth floor in the up-direction. The corresponding service zone signals L10DB–L6DB, L5DC–L2DC and L1UC–L9US take the logical state 1. Hall calls generated thereafter are not allotted to the car A but either to the car B or C, since the car A has not any service zone.

As will be appreciated from the foregoing description, according to the present invention, the estimated number of the possible passengers can be detected by adding together the number of the awaiting passengers for the allotted direction of the hall calls and the number of the passengers actually carried by the car. Further, it is possible to predict the possibility of the no vacancy by comparing the estimated number of the passengers and the allowable maximum number of the passengers. Owing to such car-full predicting feature of the invention, operating efficiency of the whole elevator system can be remarkably enhanced. More particularly, the disadvantage such as the problem of the left-off passengers due to the car-full condition, repeated registrations and allotment of the left-off calls as well as the alteration of the lamp display are eliminated according to the invention, whereby a high flexibility and enhancement can be attained in the services provided by the elevator system. The floors which are imposed with restriction in the allotment of the calls therefrom to the first car is covered by the service zone of the succeeding car and serviced thereby without incurring any difficulties.

In the embodiment described above, the estimated number of the passengers to be carried by a car is previously detected and the allotment of the hall call to the car is inhibited, when the estimated number is greater than the allowable maximum number of the passengers rated for the car.

However, it is noted that all the passengers in the car will land therefrom at the terminal floors and most of the passengers will usually get down from the car at the lobby floor and the dinning hall floor at the end of the office hours and at the lunch time. Accordingly, there may be involved errors in the determination of the estimated number of the passengers who are going to leave the car at the floor preceeding the terminal and the lobby floors, if the determination is made on the basis of estimated number of the passengers inclusive of those going to get down from the car at the lobby or the terminal floors. Inversely, it is also undesirable to determine the estimated number of the passengers whose destinations are the lobby or the terminal floors on the basis of the information inclusive of the number of the awaiting passengers who are going to get down from the car at the floors preceeding the lobby or the terminals. The reason is because the allotment of the hall calls may possibly unnecessarily be restricted, which may incur reduction in the working efficiency and the flexibility of the service of the elevator system.

FIG. 24 to 28 show another embodiment of the elevator control system according to the invention in which the situations as above mentioned are taken into consideration.

This embodiment is based on the presumption that all the floors serviced by the elevator cars are classified into a plurality of floor regions on the basis of the characteristic aspects of the individual floors such as the terminal floors at which all the passengers will get down from the car, the lobby floor at which most of the passengers leave the car at the end of the office hours or the dinning hall floor at which most of the passengers get of from the car at the lunch time. The detection of the estimated number of the passengers to be carried by a car is performed for the floor region in which the car is located. When the estimated number of the passengers becomes greater than the allowable number in a floor region, the restriction is imposed on the allotment only of the hall calls from the floors which belong to the region. Besides, the restriction on the allotment of the hall calls from the floors in the region in which the car is located on the basis of the number of the awaiting passengers at the floors outside of the region is suppressed, so far as occasion does not require such restriction.

The elevator system based on the above principle can be most effectively and advantageously employed in the building which has specified floors such as the lobby floor, the dinning hall floor or the like at which most of the passengers leave the car at particular hour bands, as described above.

In the following description, it is assumed that the lobby is at the first floor, the uppermost terminal is the tenth floor and the dinning hall is at the eighth floor.

FIG. 24 shows a circuit which corresponds to the service zone setting circuit for the car A shown in FIG. 17. In FIG. 24, same reference symbols denote the same elements as those shown in FIG. 17. The circuit of FIG. 24 is so arranged that the restriction of the service zone is effected for each of the floor regions by utilizing signals available from the circuits shown in FIGS. 25 to 28 which will be described in detail in the following.

Figure 25:
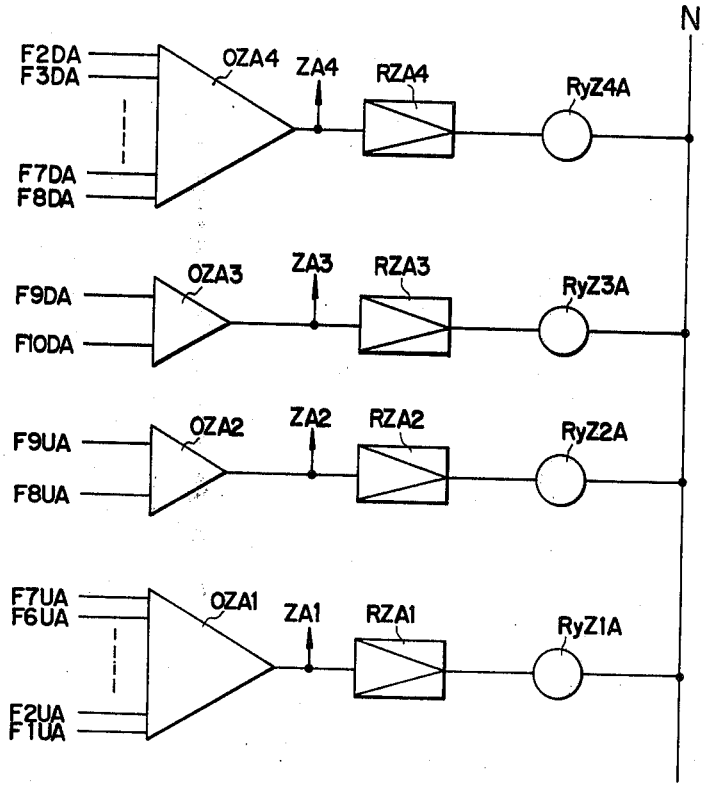
Figure 26:
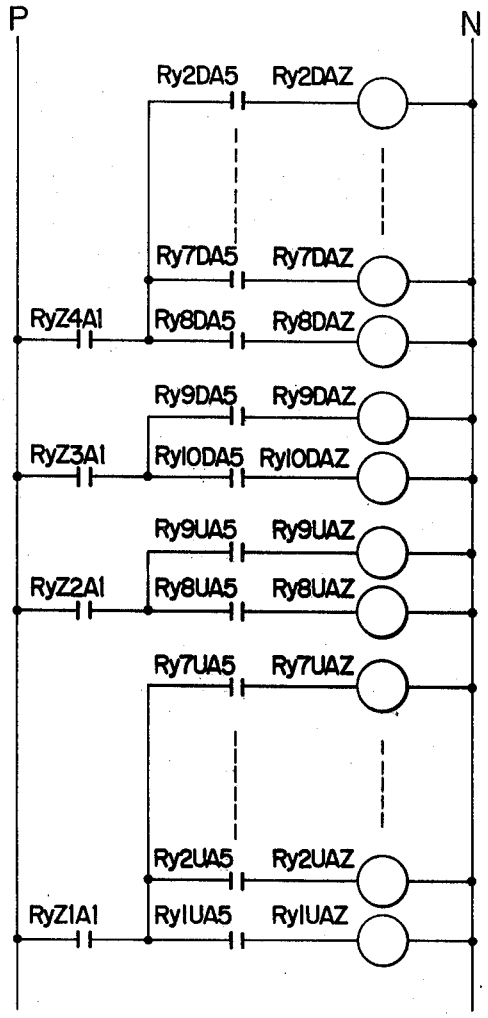

FIG. 25 shows a circuit for detecting the floor region in which the car A is running. Each of the floor regions is composed of a plurality of the floors classified relative to the lobby floor, the dinning hall floor and the uppermost or top floor. The region composed of the first to the seventh floor in the up-direction is referred to as the first floor region. The second floor region is composed of the eighth and ninth floors in the up-direction. The tenth and ninth floors in the down-direction constitute the third floor region. Finally, the fourth region is composed of the eighth to the second floors in the down-direction. Referring to FIG. 25, each of the OR elements OZA1 to OZA4 is provided for every floor region and applied at inputs with the corresponding location signals F1UA to F9UA and F10DA to F2DA of the car A. In place of these location signals, the output signals from the OR elements 01UA3–0-9UA3, 010DA3–02DA3 shown in FIG. 17 or 24 which are advanced in appearance by the time interval determination signals EOA–E2A may preferably be employed. The OR element OZA1–OZA4 provided for the floor region in which the car A is located will then produce a signal ZA1–ZA4, whereby the floor region where the car A is located can be detected. Further, the floor region detecting relay R*y*Z1A . . . , or R*y*Z4A is energized by an amplifier RZA1 . . . , or RZA4. The floor region signals ZA1 to ZA4 output from the OR elements OZA1 to OZA4 are applied to the inputs of AND elements AZA1 to AZA4, respectively, shown in FIG. 24. FIG. 26 shows the circuit for detecting the hall calls allotted for the service by the car A in the region in which the car A is located. Relays R*y*UAZ to Ry7UAZ are connected to the contact RyZ1A1 closed upon energization of the relay RyZ1A shown in FIG. 25 through the contacts Ry1UA5 to Ry7UA5 of the relays Ry1UA to Ry7UA shown in FIG. 20 which are closed when the hall calls are allotted to be serviced by the car A. The same is the case for relays Ry8UAZ, Ry9UAZ and Ry10DAZ to Ry2DAZ provided for the other floor regions.

Figure 27:
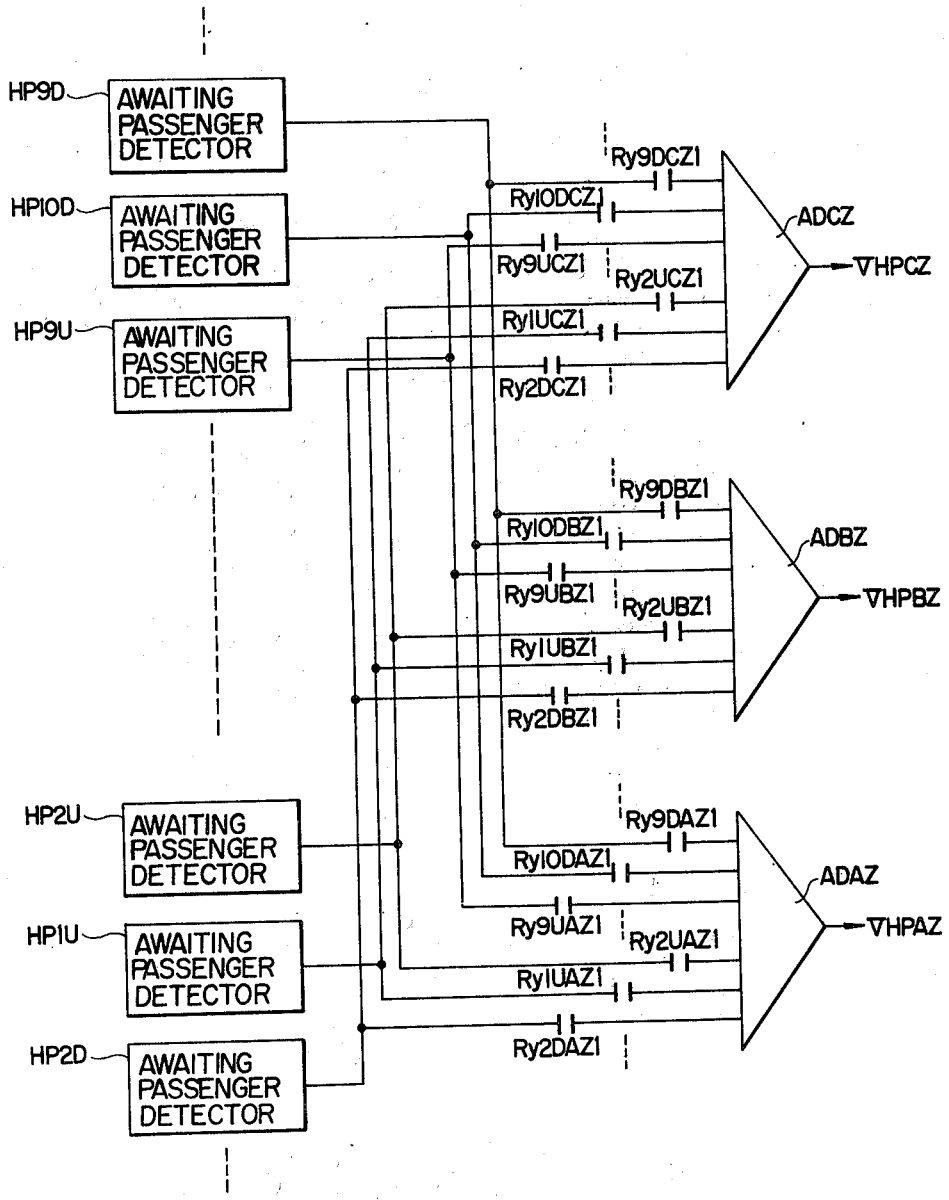

FIG. 27 shows a circuit which corresponds to the one shown in FIG. 22 and serves to sum up the numbers of the passengers awaiting at the floors in the region where the car is located for the direction of the allotted hall calls. As can be seen from the drawing, the outputs from the detection apparatus HP1U to HP9U for detecting the number of the awaiting passengers for each of the directions of their destinations are coupled to the adders ADAZ to ADCZ provided for each of the cars through the contacts Ry1UAZ1 to Ry9UAZ1 and Ry10DAZ1 to Ry2DAZ1 of the relays Ry1UAZ to Ry9UAZ and Ry10DAZ to Ry2DAZ, respectively, shown in FIG. 26.

For example, it is again assumed that the car A located at the second floor in the up-direction is allotted with the hall call for the up-direction from the seventh, eighth and the ninth floor to be serviced by the car A. Due to the fact that the car is located at the second floor in the up-direction, only the location signal F2UA shown in FIG. 25 is switched to 1 and the OR gate OZA1 produces the output 1, whereby the relay RyZ1A is energized by the amplifier RZA1. The other relays RyZ2A and RyZ3A remain deenergized. Since the hall call for the up-direction from the seventh floor is allotted to the car A, the contact Ry7UA5 shown in FIG. 26 is closed and, besides, the contact RyZ1A1 is also closed because of the energized relay RyZ1A. Accordingly, the relay Ry7UAZ in the circuit shown in FIG. 26 is turned on through the closed circuit of P-RyZ1A1-Ry7UA5-Ry7UAZ-N. Additionally, because the hall calls for the up-direction from the eighth and the ninth floors are allotted also to the car A, the contacts Ry8UA5 and Ry9UA5 are closed. However, since the relay RyZ2A is off and the contact RyZ2A1 is opened, the relays Ry8UAZ and Ry9UAZ are not energized. Furthermore, since the relay Ry7UAZ is not energized, the contact Ry7UAZ1 shown in FIG. 27 is closed, whereby the output from the detector circuit HP7U for detecting the number of the passengers for each of the directions of destinations is applied to the adder ADAZ for the car A, the output VHPAZ of which is a voltage proportional to the number of the awaiting passengers corresponding to the hall call for the up-direction from the seventh floor. The numbers of the awaiting passengers corresponding to the hall calls for the up-direction are not added to VHPAZ.

Figure 28:
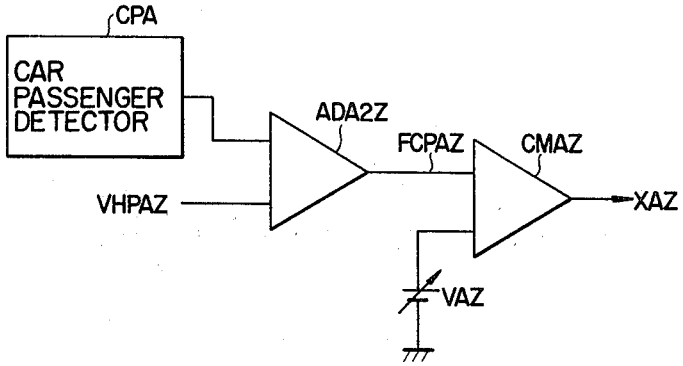

In this manner, the outputs VHPAZ, VHPBZ and VHPCZ of the adders ADAZ to ADCZ are voltages each being proportional to the sum of the numbers of the awaiting passengers corresponding to the allotted hall calls only from the floors which belong to the region in which the associated car is located. The estimated number of the passengers VHPAZ to VHPCZ for the respective cars are input to the adder ADA2Z of the circuit shown in FIG. 28 provided for each of the car and corresponding to the aforementioned cicuit shown in FIG. 24. As a result of that, the estimated number FCPAZ of the passengers in the floor region is produced by the adder ADA2Z and compared with the allowable maximum number VAX at the comparator CMAZ, which produces the car-full predicting signal of value 1 when the estimated passenger number FCPAZ increase beyond the allowable maximum value VAX, and, if otherwise, produce the signal of the logical value 0. The car-full predicting signal XAZ is coupled to the circuit shown in FIG. 24.

It is now assumed that the cars are in the state shown in FIG. 11. Since the car A is located at the second floor in the up-direction, the input F2UA to the OR element OZA1 shown in FIG. 25 is of the value 1, whereby the floor region signal ZA1 also become 1 to thereby energize the relay RyZ1A. It is further assumed that the sum of the number of the awaiting passengers in the first floor region alloted for the car A and the number of the passengers in the car A, i.e. the estimated passenger number FCPAZ in the first floor region is greater than the allowable maximum number VAZ and the car-full predicting signal XAZ of the value 1 is produced by the estimated number determination circuit shown in FIG. 28.

Since the floor region signal ZA1 and the car-full predicting signal XAZ are of the value 1, the output of the AND element AZA1 shown in FIG. 24 is also 1, whereby the inhibit elements IN1UA4 to IN7UA4 are directly inhibited, while the inhibit elements IN1UA3 to IN7UA3 are inhibited by way of the OR elements 01UA6 to 07UA6. The outputs from these inhibit elements are of the value 0. In other words, only the inhibit elements for the first floor range are inhibited, while the inhibit elements for the other floor regions are not inhibited.

If the above signal operation is put aside from the consideration, the outputs from the inhibit elements IN2UA2 to IN9UA2 will become 1, since the car A is located at the second floor in the up-direction and the time interval signal EOA is logic 1, whereby the service zone will be defined between the second and the ninth floor in the up-direction with signals L2UA to L9UA of 1 being produced, as hereinbefore described in conjunction with the circuit shown in FIG. 17.

However, since the estimated passenger number is greater than the allowable maximum value in the car A, the inhibit elements IN2UA3 to IN7UA3 are inhibited as aforementioned. Only the output signals L8UA and L9UA of the inhibit elements IN8UA2 and IN9UA2 are of the value 1 with all the other output signals being 0. In this manner, the span between the second and the seventh floor in the up-direction is excluded from the service zone, while the eighth and the ninth floors in the up-direction constitute the service zone for the car A.

The output signal 1 of the OR element O2UA3 is transmitted neither to the OR element O2UA4 nor to the circuit shown in FIG. 19, since the inhibit element In2UA4 is inhibited as described above. Accordingly, the signal 2U takes the value 0 and hence the inhibit elements IN2UA1 to IN2UC1 are not inhibited. The output of the inhibit element IN2UC1 for the car C remains at 1 level and is transmitted sequentially to the upper floors to enlarge the service zone for the car C until the output signal has been inhibited or interrupted.

On the other hand, the signal XAZ and the output signal of the inhibit element IN8UA2 which provide two inputs for the AND element A8UA4 connected to the OR element O8UA7 are both at the logic level 1, whereby the OR gate O8UA7 produces the output 1, which is then transmitted to the OR element O8UA4 through the inhibit element IN8UA4 and to the circuit (not shown) corresponding to the one shown in FIG. 19 to cause the signal 8U to be 1 and inhibit the inhibit elements IN8UA1 to IN8UC1 of the cars A, B and C. The input signal 1 to the inhibit element IN8UC1 of the car C transmitted as aforementioned is then inhibited so that the output signal from the inhibit element becomes 0.

In a similar manner, due to the location of the cars B and C at the tenth and fifth floors both in the down-direction, respectively, the signals 10D and 5D both take the value 1, whereby the inhibit elements IN1-0DA1 and IN5DB1 for the cars A and C, respectively, are inhibited to produce output 0.

In summary, when the allowable maximum number of the passengers previously set in the car A is exceeded in the fist floor region starting from the state of the cars shown in FIG. 11, the service zones for the cars A, B and C are defined, respectively, between the eighth and the ninth floors in the up-direction, between the tenth and the sixth floors in the down-direction and between the fifth and the second floors in the down-direction plus the zone between the first and the seventh floors in the up-direction. Accordingly, even if the hall call is thereafter produced in the floor region covering the second floor in the up-direction to the seventh floor preceeding just the dinning hall floor in which region the car A is located, the hall call is not allotted to the car A but to the car C.

As will be understood from the above description, in case of the embodiment shown in FIGS. 24 to 28, the generation of the car-full predicting signal for a car in one of the floor regions each composed of specific floors such as the terminal floor at which all the passengers get off from the car, the lobby and the dinning hall floors at which the most of the passengers get down from the car will inhibit the allotment of possible new calls produced in said region to the car for which the car-full predicting signal has been generated. In this manner, the estimated number of the passengers can be computed with a higher accuracy. Further, unnecessary restriction to the hall calls is suppressed. These features contributes to the enhancement of the efficient elevator operation.

In the foregoing, the detection of the estimated number of the passengers to be carried by the car in consideration of the number of the awaiting pasengers at the hall for each of the directions of destination as well as the control of the elevator system by utilizing the estimated passenger number have been descibed with the aid of the exemplary circuit arrangement shown in the drawings. In connection with the restriction imposed on the allotment of the hall calls to a particular car on the basis of the estimated number of the passengers as described hereinbefore, it is conceived that there may arise some undesirable phenomena such as those described in the following.

When the allotment of the hall calls is continued to a car until the estimated number of the passengers has exceeded the allowable maximum, then trouble may happen, if the number of the awaiting passengers is increased at the halls which have already been allotted to the above car so that the estimated number of the passengers exceeds the allowable maximum before the service is made by the car. Although the restriction is imposed on the allotment of further hall calls, the halls which have already been allotted must be serviced by the car. In such case, the car may become in the no-vacancy state before all the hall calls are serviced, as a result of which some passengers are left off as is in the case of the hitherto known elevator systems.

Moreover, the increase in the number of the awaiting passengers before the service of the hall call may be varied in dependence upon the traffic demand conditions such as the normal traffic period, the conditions at the beginning of the offic hours and at the lunch time.

Further, the destinations of the passengers may be varied depending on the running directions of the car or the floor regions, as hereinbefore described. In general, the passengers in the up-direction will often get off from the car at the floors on the way. To the contrary, most of the passengers in the down-direction will remain in the car until it has landed the lobby floor.

The present invention also contemplate the adjustment of the allowable maximum number of the passengers in view of the phenomena such as above described.

If the allowable maximum number of the passengers is set at a relatively low value, troubles such as no vacancy, left-off pasengers or the like may happen due to increase in the number of the awaiting passengers before the service by the car, as aforementioned. When the allowable maximum is set at a high value, there may remain sufficient vacancy, even after all the hall calls have been serviced, which means that unnecessary extra-restriction is imposed on the allotment of the hall calls.

The present invention therefore propose to adjust the allowable maximum number of the passengers in dependence upon the traffic demand condition, the floor regions in which the car is located or the running directions of the car.

Figure 29:
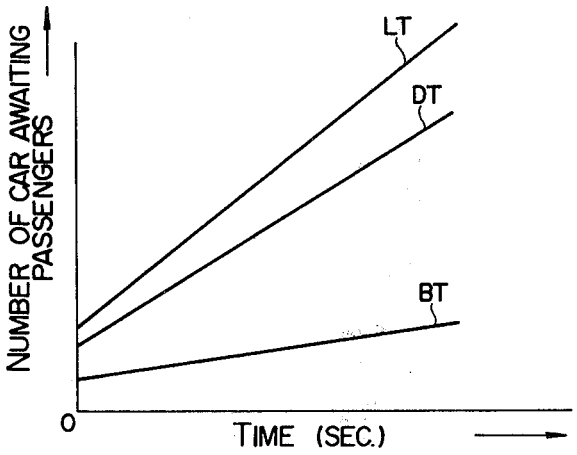
FIG. 29 shows graphically increases in the number of the car awaiting passengers after the allotment of the hall call.

FIG. 29 is a graph to show statistically increases in the number of the awaiting passengers before the service of the corresponding hall call at a certain floor. The number of the passengers awaiting at the hall is taken along the ordinate, while the time expiry after the generation of the hall call is taken along the abscissa. Considerable increases in the number of the passengers can be observed at the lunch time and at the end of the offic hours, as indicated by the curves LT and DT. During the normal traffic period, the increase is gentle (curve BT). On the basis of these observed results it is proposed according to the invention that the allowable number of the passengers is set at 60 % of the number of the passengers rated at the car at the lunch time or at the end of the office hours and at 80 % of the rated number during the normal traffic period, for example, to thereby adjust the allowable number of the passengers in dependence upon the prevailing traffic condition.

As hereinbefore described, most of the passengers who got into the car at a specific floor such as the dinning hall floor or the lobby floor at which a heavy traffic condition is likely to occur at the lunch time or at the end of the office hours or even during the normal traffic period will leave the car at the floors on the way. Inversely, most of the passengers who got into the car dispatched toward the above specific floor will not leave the car on the way. The allowable number of the passengers for a car may thus be adjusted in accordance with the dispatched directions of the car. For example, in case of the car dispatched to the specific floor, the allowable number of the passengers may be set at 60 % of the rated number. To the contrary, the allowable number may be set at 80 % of the rated number for the car which is dispatched from the specific floor.

Figure 30:
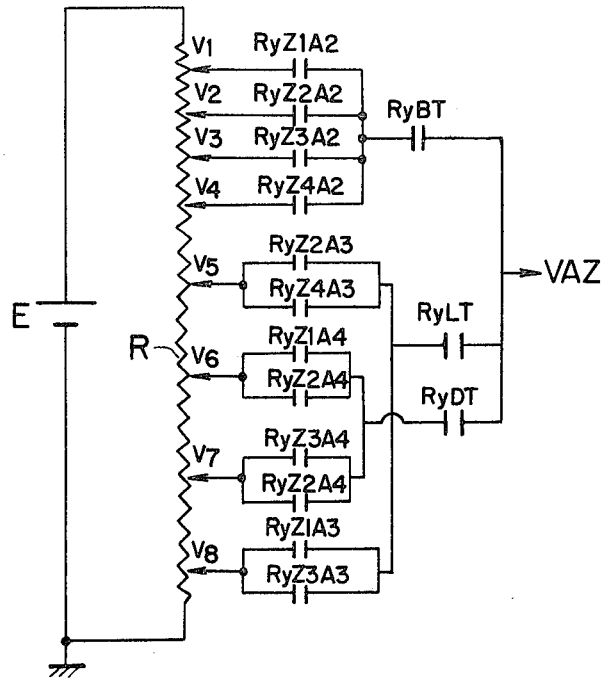
FIG. 30 shows a circuit for setting a limit value to the number of the passengers getting into a car in dependence upon the traffic demand condition according to the invention.

FIG. 30 shows an arrangement of the circuit for setting the limit value for the number of the passengers to be carries by the car A in accordance with the traffic demand conditions such as above mentioned.

In FIG. 30, the character E denotes a power source and R a setting resistor. RyBT, RyLT and RyDT represent contacts which are closed in dependence on the traffic conditions such as, for example, during the normal traffic period, at the lunch time and at the end of the office hours, respectively, and connected to set values *v*1 to *v*8 of the resistor R through the contacts of the floor region detecting relays RyZ1A to RyZ4A for the car A shown in FIG. 25. The set values *v*1 to *v*8 correspond to the limit values for the number of the passengers getting into the car A which are determined depending on the traffic demand conditions mentioned above.

Assuming that the car A is located at the second floor in the up-direction at the lunch time, the contact RyLT as well as the contacts RyZ1A2 to RyZ1A4 are turned on. Accordingly, the limit value VAZ coresponds to the set value *v*8.

The limit values VAZ for the number of the passengers getting into the car A which are produced in the above mentioned manner depending on the traffic demand conditions are applied to the input of the comparator CMAZ shown in FIG. 28 as the reference input and compared with the estimated number of the passengers. Accordingly, the car-full predicting signal become more relevant to the prevailing traffic condition, whereby the undesirable phenomena such as no-vacancy, the left-off of the passengers and the unnecessary restriction on the allotment of the hall calls may be prevented.

As the means for turning on the contacts RyBT, RyLT and RyDT in accordance with the traffic demand conditions, it is conceivable to use the driving means disclosed in the hereinbefore mentioned U.S. Pat. No. 3,642,099, a timer driver actuated in dependence on the hour bands in a day, or driving means controlled by the attendant for the elevator system.

In the foregoing, the elevator control utilizing the signal representative of the number of the passengers awaiting at halls and classified by the directions of their destination has been described by referring to various embodiments. However, it should be appreciated that the invention is never restricted to these embodiments.

For example, the allotment of the hall calls to the cars may be carried out also by dividing all the floors to be serviced by the cars into a plurality of zones whereby the allotment is determined on the basis of the spatial relations between the cars and the zones, or by allotting the call to the car located close set to the hall where the call is produced, or by any other means which allows the allotment of the hall calls to the cars in place of the aforementioned method in which the service zones are set for every car in view of the locations of the cars for effecting the allotment of the hall calls thereto. Futhermore, the hall call may be allotted to the car which has first reached the deceleration initiating point of the floor from which the hall call is generated. The inventive control principle can thus be applied to the conventional elevator system in which the deceleration is instantly initiated. In such case, determination is made in response to the allotment of the hall call whether the awaiting passengers may get into the car by adding together the number of the awaiting passengers for the direction of the allotted call and the number of the passengers in the car, whereby judgement can be rapidly done if the car should stop at the floor or not.

In the disclosed embodiments, the allotment of the hall calls is restricted in dependence upon the estimated number of the passengers to be carried by the car. Such estimated number may be displayed in the car or advised to the attendant. Further, the carfull predicting signal may be easily displayed at the hall. Moreover, the allowable number of the passengers getting into the car may be obtained by subtracting the estimated number of the passenger from the limit number of the passengers set depending on the traffic conditions.

The present invention has now provided a novel traffic information concerning the number of the passengers awaiting at halls and classified for each of the directions of their destinations, which information allows the detection of the estimated number of the passengers to be carried by the car and the prediction of the possibility of no vacancy in the car. The principle of the invention can be flexibly employed in a variety of the elevator controls without being restricted to the disclosed embodiments.

The invention has been described with the aid of the embodiments in which analogue circuits are employed for the better understanding of the invention. However, the principle of the invention can be easily realized by using digital circuits and computer, the use of which have been lately attempted in the field of the elevator control, as a higher accuracy is demanded in the control.

What we claim is:

1. A control apparatus for elevators comprising a registrating means installed at an elevator hall for registrating hall calls for the up-direction and the down-direction to thereby make elevator cars to service in accordance with the directions of the registrated hall calls, characterized by a detection means for detecting the number of passengers awaiting the cars at hall for each of the directions of the registrated hall calls, which detection means comprises means for detecting the number of the car awaiting passengers at the elevator hall, means for detecting the registration of the hall calls for the up- and down-directions at the same hall, means for setting ratios for dividing the number of the car awaiting passengers for each of the up- and down-directions, means for dividing said detected number of the car awaiting passengers for the up-direction and for the down-direction on the basis of said set ratios, when the hall calls for both directions are registrated, and means for imparting said detected number of the car awaiting passengers with one of the directions, when the hall calls for said one direction are registrated.

2. A control apparatus as set forth in claim 1, characterized in that said means for setting said dividing ratio comprises means for setting previously predetermined ratios, repectively, for the up-direction and the down-direction.

3. A control apparatus as set forth in claim 1, characterized in that said means for setting the dividing ratio comprises adjusting means for arbitrarily adjusting the ratios, respectively, for the up-direction and the down-direction.

4. A control apparatus as set forth in claim 3, characterized in that means for detecting traffic demand conditions of the elevator is provided to adjust said adjusting means in dependence upon the detected traffic demand condition.

5. A control apparatus as set forth in claim 4, characterized in that said apparatus further comprises means for detecting the number of the passengers getting into the car at the same floor for each of the up- and down-directions, means for calculating ratios of the passengers getting into the car for each of the directions from said detected number of the passengers getting into the car, whereby said adjusting means are adjusted in accordance with said passenger ratios.

6. A control apparatus as set forth in claim 5, further comprising means for detecting the number of the passengers getting into the car at the same floor for each of said directions in dependence upon the traffic demand condition, and means for calculating the ratio of the passengers getting into car in dependence upon the traffic demand condition from said detected number of the passengers getting into the car, wherein said adjusting means are adjusted by said passenger ratio.

7. A control apparatus as set forth in claim 5, further comprising means for resetting the detected value of said detection means for detecting the number of the passengers getting into the car.

8. A control apparatus as set forth in claim 7, characterized in that said reset means is actuated when a predetermined duration has passed after the initiation of the operation of said detection means for detecting the number of the passengers getting into the car.

9. A control apparatus as set forth in claim 7, characterized in that said reset means is actuated when the detected value of said detection means for detecting the number of the passengers into the car attains a predetermined value.

10. A control apparatus as set forth in claim 7, characterized in that said reset means is adapted to be actuated when variation occurs in the passengers using the elevator.

11. A control apparatus as set forth in claim 5, further comprising means for previously setting said dividing ratios, and means for changing over said presetting means with the means for adjusting said dividing ratios in dependence on said passenger ratio.

12. A control apparatus as set forth in claim 1, wherein a plurality of cars are provided in the juxtaposed configuration, further comprising means for alloting said registrated hall calls to a given car, means for detecting the number of the passengers in each of said cars and means for detecting the estimated number of the passengers in each of said cars, the last mentioned means being composed of adder means for adding together the number of the passengers in the car and the number of the car awaiting passengers for the direction of the hall calls allotted to said car.

13. A control apparatus as set forth in claim 12, further comprising means for setting a limit value to the number of the passengers getting into the car and means for predicting the no-vacancy condition of the car, the last mentioned means being composed of means for comparing said estimated number of the passengers with said limit value.

14. A control apparatus as set forth in claim 13, further comprising means for restricting the allotment of the hall calls to the car for which said no-vacancy condition is predicted.

15. A control apparatus as set forth in claim 12, further comprising means for detecting the allotted hall calls in a predetermined region and means for detecting the estimated passengers in said predetermined region, the last mentioned being composed of means for adding together the number of the passenger in the car and the number of the car awaiting passengers for the direction of the hall calls allotted to said car in said predetermined region.

16. A control apparatus as set forth in claim 15, further comprising means for setting a limit value to the number of the passengers getting into the car, means for comparing the estimated number of the passengers in said predetermined region with said limit value to thereby predict the possiblity of no-vacancy condition in the car, and means for restricting the allotment of the hall call in said predetermined region to the car for which said no-vacancy condition is predicted.

17. A control apparatus as set forth in claim 13, wherein said means for setting said limit value comprises means for arbitrarily adjusting said limit value.

18. A control apparatus as set forth in claim 16, wherein said means for setting said limit value comprises means for arbitrarily adjusting said limit value.

19. A control apparatus as set forth in claim 14, further comprising means for allotting the hall calls the allotment of which is restricted for the car predicted of the no-vacancy condition to the other car.

20. A control apparatus as set forth in claim 16, further comprising means for allotting the hall calls restricted in the allotment thereof to the car predicted of the no-vacancy condition to the other car.

* * * * *